US008010011B2

(12) United States Patent
Tsui et al.

(10) Patent No.: US 8,010,011 B2
(45) Date of Patent: Aug. 30, 2011

(54) REMOVABLY MOUNTABLE FRAME FOR AN IMAGE PROCESSSING APPARATUS, A REMOVABLY MOUNTABLE ADAPTOR FOR AN IMAGE PROCESSING APPARATUS AND CARTRIDGES FOR USE WITH A REMOVABLY FRAME AND REMOVABLY MOUNTABLE ADAPTOR

(75) Inventors: Samuel Tsui, Hong Kong (CN); Christopher Paul Mercer, Dongara (AU)

(73) Assignee: Katun Corporation, Minneapolis, MN (US)

( * ) Notice: Subject to any disclaimer, the term of this patent is extended or adjusted under 35 U.S.C. 154(b) by 580 days.

(21) Appl. No.: 11/994,761

(22) PCT Filed: Jul. 5, 2006

(86) PCT No.: PCT/AU2006/000936

§ 371 (c)(1),
(2), (4) Date: Apr. 6, 2008

(87) PCT Pub. No.: WO2007/003005

PCT Pub. Date: Jan. 11, 2007

(65) Prior Publication Data

US 2008/0199212 A1 Aug. 21, 2008

(30) Foreign Application Priority Data

Jul. 5, 2005 (AU) ..... 2005903654

(51) Int. Cl.
*G03G 21/16* (2006.01)

(52) U.S. Cl. ..... 399/110; 399/113

(58) Field of Classification Search ..... 399/111, 399/113, 119, 110, 117, 167
See application file for complete search history.

(56) References Cited

U.S. PATENT DOCUMENTS

| | | | | |
|---|---|---|---|---|
| 4,432,632 | A * | 2/1984 | Yokota | 399/113 |
| 5,528,343 | A * | 6/1996 | Tada et al. | 399/113 |
| 6,584,293 | B1 | 6/2003 | Wang et al. | |
| 6,813,469 | B2 * | 11/2004 | Park | 399/360 |
| 7,062,192 | B2 * | 6/2006 | Oguma et al. | 399/90 |
| 7,305,204 | B2 * | 12/2007 | Carter et al. | 399/113 |
| 7,526,228 | B2 * | 4/2009 | Shiraki | 399/111 |
| 7,747,191 | B2 * | 6/2010 | Kawasumi | 399/111 |

FOREIGN PATENT DOCUMENTS

| | | |
|---|---|---|
| EP | 1118914 A2 | 7/2001 |
| EP | 1207437 A2 | 5/2002 |
| EP | 1403734 A1 | 3/2004 |

* cited by examiner

*Primary Examiner* — Robert Beatty
(74) *Attorney, Agent, or Firm* — Schwegman, Lundberg & Woessner, P.A.

(57) ABSTRACT

A removably mountable frame comprising a driving force receiving means adapted to engage a driving force transmitting means of an image processing apparatus when the removably mountable frame is received within the image processing apparatus; and at least one frame driving force transmitting means, each frame driving force transmitting means adapted to co-axially engage corresponding cartridge driving force receiving means of a cartridge when the cartridge is engagedly received within the removably mountable frame, where the external configuration of the removably mountable frame when the cartridge is received therein is adapted to be received within the image processing apparatus and where the driving force receiving means is further adapted to transfer driving force applied thereto to each of the at least one frame driving force transmitting means.

110 Claims, 13 Drawing Sheets

REMOVABLY MOUNTABLE FRAME FOR AN IMAGE PROCESSSING APPARATUS, A REMOVABLY MOUNTABLE ADAPTOR FOR AN IMAGE PROCESSING APPARATUS AND CARTRIDGES FOR USE WITH A REMOVABLY FRAME AND REMOVABLY MOUNTABLE ADAPTOR

FIELD OF THE INVENTION

The invention relates to a removably mountable frame for an image processing apparatus or a removably mounted adaptor for an image processing apparatus and a cartridge adapted to be received within the removably mountable frame. The invention is particularly suited to laser printers, copiers, faxes and multi-function devices, but should not be construed as limited to use in such products.

BACKGROUND TO THE INVENTION

The following discussion of the background invention is intended to facilitate an understanding of the present invention. However, it should be appreciated that the discussion is not an acknowledgment or admission that any of the material referred to was published, known or part of the common general knowledge in any jurisdiction as at the priority date of the application.

Image processing apparatus typically use a disposable process cartridge as a means of controlling the quality of images developed by the image processing apparatus. While certain components of the common disposable process cartridge require replacing in order to maintain image quality others, such as the gearing mechanisms and electrical contacts, do not. However, ease of manufacture and user implementation considerations have always negated the advantages of separating out those components not requiring disposal from those that do.

Furthermore, with almost each new family of image processing apparatuses developed, the manufacturer creates a new cartridge configuration. This results in further wastage of resources as a single cartridge design is often restricted to be able to be used in a single family of image processing apparatuses.

It is therefore an object of the present invention to overcome, at least in part, some or all of the aforementioned problems.

SUMMARY OF THE INVENTION

Throughout this document, unless otherwise indicated to the contrary, the terms "comprising", "consisting of", and the like, are to be construed as non-exhaustive, or in other words, as meaning "including, but not limited to".

In accordance with a first aspect of the invention there is a removably mountable frame comprising:

a driving force receiving means adapted to engage a driving force transmitting means of an image processing apparatus when the removably mountable frame is received within the image processing apparatus; and at least one frame driving force transmitting means, each frame driving force transmitting means adapted to co-axially engage corresponding cartridge driving force receiving means of a cartridge when the cartridge is engagedly received within the removably mountable frame, where the external configuration of the removably mountable frame when the cartridge is received therein is adapted to be received within the image processing apparatus and where the driving force receiving means is further adapted to transfer driving force applied thereto to each of the at least one frame driving force transmitting means.

Preferably, when the cartridge release means is set to a first position, the at least one frame driving force transmitting means disengage the cartridge driving force receiving means and at least partially retracts into a housing and where, when the cartridge release means is set to a second position, the at least one frame driving force transmitting means at least partially projects from the housing to co-axially engage the corresponding cartridge driving force receiving means. The cartridge release means may be one of the following: a lever; a switch; or push-button.

The driving force receiving means may be directly connected with one of the at least one frame driving force transmitting means. The removably mountable frame may also include struts and/or braces to provide support for the cartridge when received therein.

Recesses or cut-away portions may be provided within the frame to facilitate correct receipt of the cartridge within the removably mountable frame. Alternatively, or cumulatively, ridges or protrusions may extend from the frame to facilitate correct receipt of the cartridge.

Preferably, a first locking mechanism may be included to securely connect the removably mountable frame to the image processing apparatus and maintain the frame's position within the image processing apparatus. The first locking mechanism may be adapted to prevent engagement of the cartridge within the frame prior to the removably mountable frame being engagedly received within the image processing apparatus.

The removably mountable frame may also comprise a second locking mechanism to secure the cartridge in position relative to the frame. The second locking mechanism may be adapted to engage the cartridge prior to the frame driving force transmitting means engaging the cartridge driving force receiving means.

Preferably, at least one electrical contact is provided for on the frame to facilitate the transfer of electrical power from the image processing apparatus to the removably mountable frame. Ideally, the electrical contact is an electrode.

The frame may also have at least one micro-processor to facilitate the exchange of information between the frame and the image processing apparatus.

Ideally, the frame further comprises actuation means for actuating interior elements of the image processing apparatus required to effect normal operation of the cartridge.

In accordance with a second aspect of the present invention there is a cartridge for use in a removably mountable frame according to the first aspect of the invention, the cartridge comprising:

at least one xerographic component; and at least one cartridge driving force receiving member, one of the at least one cartridge driving force receiving members adapted to transfer driving force applied thereto to one of the at least one xerographic components, where the cartridge is adapted to be received in the removably mountable frame such that each of the at least one cartridge driving force receiving members co-axially engages a corresponding frame driving force transmitting means.

Preferably, the at least one xerographic component includes at least one of the following: a developer roller; a photosensitive drum; an agitator. More preferably, the at least one xerographic component further includes at least one of the following: a toner hopper; a cleaning blade; a charging system; a supply roller; a triboelectric blade a scavenger unit.

Ideally, if the cartridge includes a toner hopper, the toner hopper is removable. The toner hopper may only be able to be removed from the cartridge a predetermined number of times.

Alternatively, if the cartridge includes a toner hopper, the toner hopper has an outlet provided therein to facilitate replenishment of toner stored therein.

Preferably, when the at least one xerographic component includes a photosensitive drum, the cartridge further comprises a first longitudinal aperture positioned and of a width such that, when the mated cartridge and frame are received within an image processing apparatus, a light source mounted within the image processing apparatus can ascribe an image onto the photosensitive drum along its full process width through the first longitudinal aperture. The cartridge may further comprise a retractable cover adapted to cover the first longitudinal aperture in a first position and to at least partially uncover the first longitudinal aperture in a second position, the retractable cover based towards the first position and operable to overcome the bias and move to the second position when the cartridge is received within the removably mountable frame.

Alternatively or cumulatively, where the at least one xerographic component includes a photosensitive drum, the cartridge further comprises a second longitudinal aperture positioned and of a width such that, when the mated cartridge and frame are received within an image processing apparatus, an image ascribed onto the full process width of the photosensitive drum can be transferred to a transfer medium by way of the second longitudinal aperture. The cartridge may again further comprise a retractable cover adapted to cover the second longitudinal aperture in a first position and to at least partially uncover the second longitudinal aperture in a second position, the retractable cover based towards the first position and operable to overcome the bias and move to the second position when the cartridge is received within the removably mountable frame.

Preferably, the cartridge has at least one electrical contact to facilitate the transfer of electrical power from either the reusable frame or an image processing apparatus in which the reusable frame is received. Ideally, the contact is an electrode.

Preferably, the cartridge has at least one micro-processor to facilitate the exchange of information between the cartridge and the reusable frame or the cartridge and an image processing apparatus in which the reusable frame is received.

In accordance with a third aspect of the invention there is a removably mountable frame comprising:

a driving force receiving means adapted to engage a driving force transmitting means of an image processing apparatus when the removably mountable frame is received within the image processing apparatus; and at least two frame driving force transmitting means, each frame driving force transmitting means having a gear located at the same end thereof adapted to engage at least one cartridge driving force receiving means of a cartridge when the cartridge is engagedly received within the removably mountable frame, where the external configuration of the removably mountable frame when the cartridge is received therein is adapted to be received within the image processing apparatus and where the driving force receiving means is further adapted to transfer driving force applied thereto to each of the at least two frame driving force transmitting means.

Preferably, when the cartridge release means is set to a first position, the at least two frame driving force transmitting means disengage the cartridge driving force receiving means and at least partially retracts into a housing and where, when the cartridge release means is set to a second position, the at least two frame driving force transmitting means at least partially projects from the housing to engage the corresponding cartridge driving force receiving means. The cartridge release means may be one of the following: a lever; a switch; or push-button.

The driving force receiving means may be directly connected with one of the at least one frame driving force transmitting means. The removably mountable frame may also include struts and/or braces to provide support for the cartridge when received therein.

Recesses or cut-away portions may be provided within the frame to facilitate correct receipt of the cartridge within the removably mountable frame. Alternatively, or cumulatively, ridges or protrusions may extend from the frame to facilitate correct receipt of the cartridge.

Preferably, a first locking mechanism may be included to securely connect the removably mountable frame to the image processing apparatus and maintain the frame's position within the image processing apparatus. The first locking mechanism may be adapted to prevent engagement of the cartridge within the frame prior to the removably mountable frame being engagedly received within the image processing apparatus.

The removably mountable frame may also comprise a second locking mechanism to secure the cartridge in position relative to the frame. The second locking mechanism is adapted to engage the cartridge prior to the frame driving force transmitting means engaging the cartridge driving force receiving means.

Preferably, at least one electrical contact is provided for on the frame to facilitate the transfer of electrical power from the image processing apparatus to the removably mountable frame. Ideally, the electrical contact is an electrode.

The frame may also have at least one micro-processor to facilitate the exchange of information between the frame and the image processing apparatus.

Ideally, the frame further comprises actuation means for actuating interior elements of the image processing apparatus required to effect normal operation of the cartridge.

In accordance with a fourth aspect of the invention there is a cartridge for use in a removably mountable frame according to the third aspect of the invention, the cartridge comprising:

at least one xerographic component; and at least two cartridge driving force receiving member, each of the at least two cartridge driving force receiving members adapted to transfer driving force applied thereto to one of the at least one xerographic components, where the cartridge is adapted to be received in the removably mountable frame such that each of the at least two cartridge driving force receiving members engages at least one frame driving force transmitting means.

Preferably, the at least one xerographic component includes at least one of the following: a developer roller; a photosensitive drum; an agitator. More preferably, the at least one xerographic component further includes at least one of the following: a toner hopper; a cleaning blade; a charging system; a supply roller; a triboelectric blade a scavenger unit.

Ideally, if the cartridge includes a toner hopper, the toner hopper is removable. The toner hopper may only be able to be removed from the cartridge a predetermined number of times.

Alternatively, if the cartridge includes a toner hopper, the toner hopper has an outlet provided therein to facilitate replenishment of toner stored therein.

Preferably, when the at least one xerographic component includes a photosensitive drum, the cartridge further comprises a first longitudinal aperture positioned and of a width such that, when the mated cartridge and frame are received within an image processing apparatus, a light source mounted within the image processing apparatus can ascribe an image onto the photosensitive drum along its full process width through the first longitudinal aperture. The cartridge may further comprise a retractable cover adapted to cover the first longitudinal aperture in a first position and to at least partially uncover the first longitudinal aperture in a second position, the retractable cover based towards the first position and operable to overcome the bias and move to the second position when the cartridge is received within the removably mountable frame.

Alternatively or cumulatively, where the at least one xerographic component includes a photosensitive drum, the cartridge further comprises a second longitudinal aperture positioned and of a width such that, when the mated cartridge and frame are received within an image processing apparatus, an image ascribed onto the full process width of the photosensitive drum can be transferred to a transfer medium by way of the second longitudinal aperture. The cartridge may again further comprise a retractable cover adapted to cover the second longitudinal aperture in a first position and to at least partially uncover the second longitudinal aperture in a second position, the retractable cover based towards the first position and operable to overcome the bias and move to the second position when the cartridge is received within the removably mountable frame.

Preferably, the cartridge has at least one electrical contact to facilitate the transfer of electrical power from either the reusable frame or an image processing apparatus in which the reusable frame is received. Ideally, the electrical contact is an electrode.

Preferably, the cartridge has at least one micro-processor to facilitate the exchange of information between the cartridge and the reusable frame or the cartridge and an image processing apparatus in which the reusable frame is received.

In accordance with a fifth aspect of the invention there is a removably mountable adaptor comprising:

a driving force receiving means adapted to engage a driving force transmitting means of an image processing apparatus when the removably mountable adaptor is received within the image processing apparatus; and at least one adaptor driving force transmitting means, each adaptor driving force transmitting means adapted to co-axially engage corresponding cartridge driving force receiving means of a cartridge when the cartridge is engagedly connected to the removably mountable adaptor, where the external configuration of the removably mountable adaptor when the cartridge is connected thereto is adapted to be received within the image processing apparatus and where the driving force receiving means is further adapted to transfer driving force applied thereto to each of the at least one adaptor driving force transmitting means.

Preferably, when the cartridge release means is set to a first position, the at least one adaptor driving force transmitting means disengages the cartridge driving force receiving means and at least partially retracts into a housing and where, when the cartridge release means is set to a second position, the at least one adaptor driving force transmitting means at least partially projects from the housing to co-axially engage the corresponding cartridge driving force receiving means. The cartridge release means may be one of the following: a lever; a switch; or push-button.

The driving force receiving means may be directly connected with one of the at least one adaptor driving force transmitting means.

Recesses or cut-away portions within the adaptor to facilitate correct connection of the cartridge to the removably mountable adaptor. Alternatively, or cumulatively, ridges or protrusions extend from the adaptor to facilitate correct receipt of the cartridge.

Preferably, a first locking mechanism may be included to securely connect the removably mountable adaptor to the image processing apparatus and maintain the adaptor's position within the image processing apparatus. The first locking mechanism may be adapted to prevent connection of the cartridge to the adaptor prior to the removably mountable adaptor being engagedly received within the image processing apparatus.

The removably mountable adaptor may also comprise a second locking mechanism to secure the connection of the cartridge to the adaptor. The second locking mechanism may be adapted to engage the cartridge prior to the adaptor driving force transmitting means engaging the cartridge driving force receiving means.

Preferably, at least one electrical contact is provided for on the frame to facilitate the transfer of electrical power from the image processing apparatus to the removably mountable adaptor. Ideally, the electrical contact is an electrode.

The frame may also have at least one micro-processor to facilitate the exchange of information between the adaptor and the image processing apparatus.

Ideally, the adaptor further comprises actuation means for actuating interior elements of the image processing apparatus required to effect normal operation of the cartridge.

In accordance with a sixth aspect of the present invention there is a cartridge for use in a removably mountable adaptor according to the fifth aspect of the invention, the cartridge comprising:

at least one xerographic component; and at least one cartridge driving force receiving member, one of the at least one cartridge driving force receiving members adapted to transfer driving force applied thereto to one of the at least one xerographic components, where the cartridge is adapted to be connected to the removably mountable adaptor such that each of the at least one cartridge driving force receiving members co-axially engages a corresponding adaptor driving force transmitting means.

Preferably, the at least one xerographic component includes at least one of the following: a developer roller; a photosensitive drum; an agitator. More preferably, the at least one xerographic component further includes at least one of the following: a toner hopper; a cleaning blade; a charging system; a supply roller; a triboelectric blade a scavenger unit.

Ideally, if the cartridge includes a toner hopper, the toner hopper is removable. The toner hopper may only be able to be removed from the cartridge a predetermined number of times.

Alternatively, if the cartridge include a toner hopper, the toner hopper has an outlet provided therein to facilitate replenishment of toner stored therein.

Preferably, when the at least one xerographic component includes a photosensitive drum, the cartridge further comprises a first longitudinal aperture positioned and of a width such that, when the mated cartridge and frame are received within an image processing apparatus, a light source mounted within the image processing apparatus can ascribe an image onto the photosensitive drum along its full process width through the first longitudinal aperture. The cartridge may further comprise a retractable cover adapted to cover the first longitudinal aperture in a first position and to at least partially uncover the first longitudinal aperture in a second position, the retractable cover based towards the first position and operable to overcome the bias and move to the second position when the cartridge is received within the removably mountable frame.

Alternatively or cumulatively, where the at least one xerographic component includes a photosensitive drum, the cartridge further comprises a second longitudinal aperture positioned and of a width such that, when the mated cartridge and frame are received within an image processing apparatus, an image ascribed onto the full process width of the photosensitive drum can be transferred to a transfer medium by way of the second longitudinal aperture. The cartridge may again further comprise a retractable cover adapted to cover the second longitudinal aperture in a first position and to at least partially uncover the second longitudinal aperture in a second position, the retractable cover based towards the first position and operable to overcome the bias and move to the second position when the cartridge is received within the removably mountable frame.

Preferably, the cartridge has at least one electrical contact to facilitate the transfer of electrical power from either the reusable frame or an image processing apparatus in which the reusable frame is received. Ideally, the electrical contact is an electrode.

Preferably, the cartridge has at least one micro-processor to facilitate the exchange of information between the cartridge and the removably mountable adaptor or the cartridge and an image processing apparatus in which the removably mountable adaptor is received.

In accordance with a seventh aspect of the invention there is a removably mountable adaptor comprising:

a driving force receiving means adapted to engage a driving force transmitting means of an image processing apparatus when the removably mountable adaptor is received within the image processing apparatus; and at least two adaptor driving force transmitting means, each adaptor driving force transmitting means having a gear located at the same end thereof adapted to engage at least one cartridge driving force receiving means of a cartridge when the cartridge is engagedly connected to the removably mountable adaptor, where the external configuration of the removably mountable adaptor when the cartridge is connected thereto is adapted to be received within the image processing apparatus and where the driving force receiving means is further adapted to transfer driving force applied thereto to each of the at least two adaptor driving force transmitting means.

Preferably, when the cartridge release means is set to a first position, the at least two adaptor driving force transmitting means disengage the cartridge driving force receiving means and at least partially retracts into a housing and where, when the cartridge release means is set to a second position, the at least two adaptor driving force transmitting means at least partially projects from the housing to engage the corresponding cartridge driving force receiving means. The cartridge release means may be one of the following: a lever; a switch; or push-button.

The driving force receiving means may be directly connected with one of the at least one adaptor driving force transmitting means.

Recesses or cut-away portions within the adaptor to facilitate correct receipt of the cartridge within the removably mountable adaptor. Alternatively, or cumulatively, ridges or protrusions extend from the adaptor to facilitate correct receipt of the cartridge.

Preferably, a first locking mechanism may be included to securely connect the removably mountable adaptor to the image processing apparatus and maintain the adaptor's position within the image processing apparatus. The first locking mechanism may be adapted to prevent connection of the cartridge to the adaptor prior to the removably mountable adaptor being engagedly received within the image processing apparatus.

The removably mountable adaptor may also comprise a second locking mechanism to secure the connection of the cartridge to the adaptor. The second locking mechanism may be adapted to connect the cartridge prior to the adaptor driving force transmitting means engaging the cartridge driving force receiving means.

Preferably, at least one electrical contact to facilitate the transfer of electrical power from the image processing apparatus to the removably mountable adaptor. Ideally, the electrical contact is an electrode.

The removably mountable adaptor may also have at least one micro-processor to facilitate the exchange of information between the adaptor and the image processing apparatus.

Ideally, the removably mountable adaptor further comprises actuation means for actuating interior elements of the image processing apparatus required to effect normal operation of the cartridge.

In accordance with an eight aspect of the present invention there is a cartridge for use in a removably mountable adaptor according to the seventh aspect of the invention, the cartridge comprising:

at least one xerographic component; and at least two cartridge driving force receiving member, each of the at least two cartridge driving force receiving members adapted to transfer driving force applied thereto to one of the at least one xerographic components, where the cartridge is adapted to be connected to the removably mountable adaptor such that each of the at least two cartridge driving force receiving members engages at least one adaptor driving force transmitting means.

Preferably, the at least one xerographic component includes at least one of the following: a developer roller; a photosensitive drum; an agitator. More preferably, the at least one xerographic component further includes at least one of the following: a toner hopper; a cleaning blade; a charging system; a supply roller; a triboelectric blade a scavenger unit.

Ideally, if the cartridge includes a toner hopper, the toner hopper is removable. The toner hopper may only be able to be removed from the cartridge a predetermined number of times.

Alternatively, if the cartridge includes a toner hopper, the toner hopper has an outlet provided therein to facilitate replenishment of toner stored therein.

Preferably, when the at least one xerographic component includes a photosensitive drum, the cartridge further comprises a first longitudinal aperture positioned and of a width such that, when the mated cartridge and frame are received within an image processing apparatus, a light source mounted within the image processing apparatus can ascribe an image onto the photosensitive drum along its full process width through the first longitudinal aperture. The cartridge may further comprise a retractable cover adapted to cover the first longitudinal aperture in a first position and to at least partially uncover the first longitudinal aperture in a second position, the retractable cover based towards the first position and operable to overcome the bias and move to the second position when the cartridge is received within the removably mountable frame.

Alternatively or cumulatively, where the at least one xerographic component includes a photosensitive drum, the cartridge further comprises a second longitudinal aperture positioned and of a width such that, when the mated cartridge and frame are received within an image processing apparatus, an image ascribed onto the full process width of the photosensitive drum can be transferred to a transfer medium by way of the second longitudinal aperture. The cartridge may again further comprise a retractable cover adapted to cover the second longitudinal aperture in a first position and to at least partially uncover the second longitudinal aperture in a second position, the retractable cover based towards the first position and operable to overcome the bias and move to the second position when the cartridge is received within the removably mountable frame.

Preferably, the cartridge has at least one electrical contact to facilitate the transfer of electrical power from either the removably mountable adaptor or an image processing apparatus in which the removably mountable adaptor is received. Ideally, the electrical contact is an electrode.

Preferably, the cartridge has at least one micro-processor to facilitate the exchange of information between the cartridge and the removably mountable adaptor or the cartridge and an image processing apparatus in which the removably mountable adaptor is received.

BRIEF DESCRIPTION OF THE DRAWINGS

The invention will now be described, by way of example only, with reference to the accompanying drawings, in which.

PREFERRED EMBODIMENTS OF THE INVENTION

Figure 1:
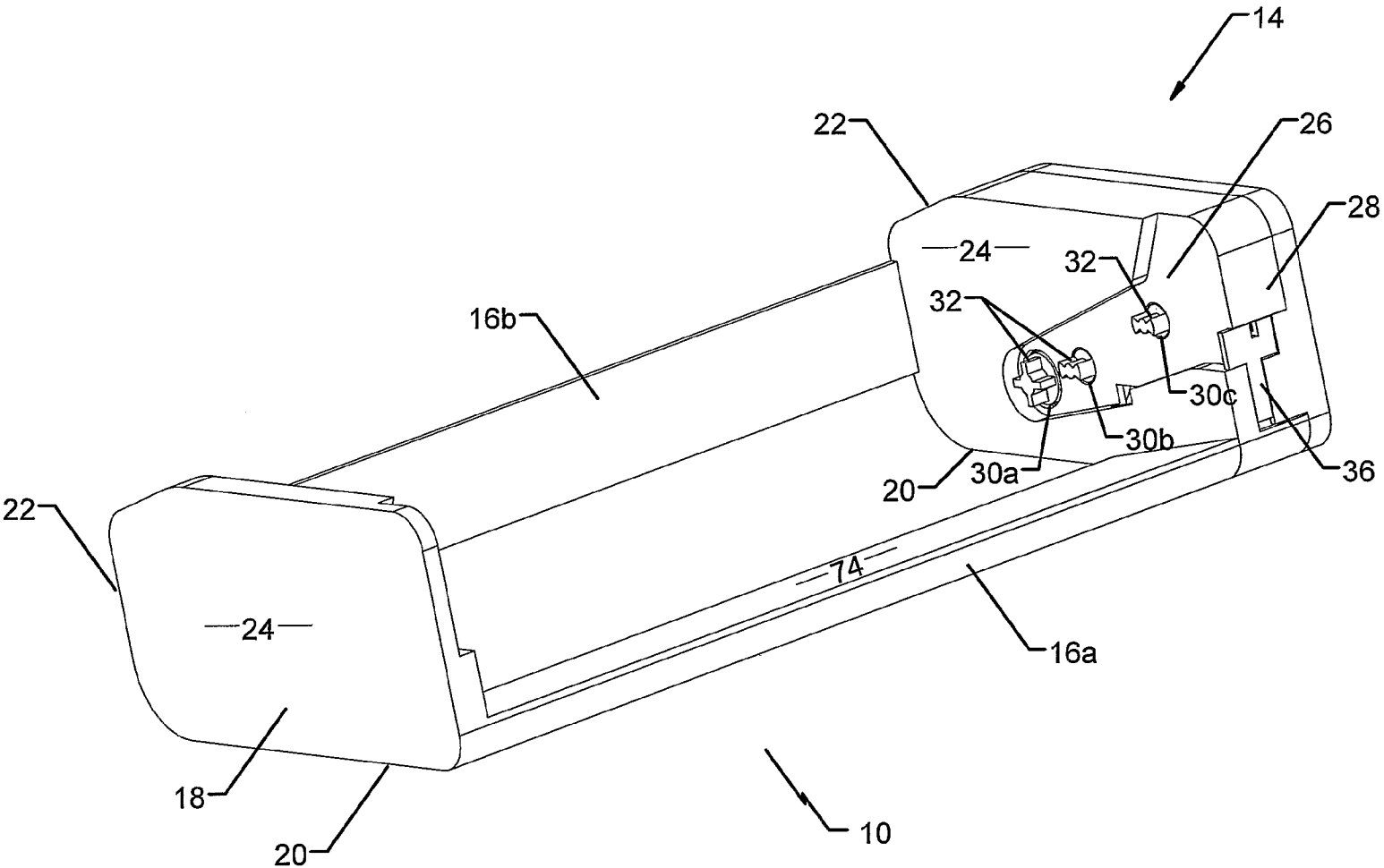
FIG. 1 is a first top isometric view of a removably mountable frame according to a first embodiment of the invention.

In accordance with a first embodiment of the invention there is a removably mountable frame 10 for use in an image processing apparatus (not shown). The removably mountable frame 10 comprises:

a gearing housing 14,
spacers 16*a*, 16*b*; and
a side brace 18.

The gearing housing 14 and side brace 18 are connected by spacer 16*a* at first sides 20 and by spacer 16*b* at second sides 22. In this manner, gearing housing 14 and side brace 18 form two sides 24 of the removably mountable frame 10. Gearing housing 14 and side brace 18 have the same cross-sectional profile when taken along plane A (plane A being transverse to the orientation of spacers 16*a*, 16*b*).

The gearing housing 14 has a cut-away portion 26 on its internal side. The cut-away portion 26 extends from side 28 towards spacer 16*b* in a tapered fashion.

Positioned within the cut-away portion 26 are three apertures 30*a*, 30*b*, 30*c*. Apertures 30*a*, 30*b*, 30*c* are adapted to receive drive force transmitting means 32*a*, 32*b*, 32*c*, respectively.

In the embodiment shown, drive force transmitting means 32*a* is a cog having a cylindrical main shaft having four equidistant box-shaped teeth disposed thereabout. Drive force transmitting means 32*b*, 32*c* each comprise a cylindrical main shaft having two equidistant substantially triangular shaped wings disposed thereabout (such that the drive force transmitting means 32*b*, 32*c* each are similar in shape to a bow tie).

The gearing housing 14 also has a lever 36 attached thereto. The lever 36 comprises an actuating portion 40 and a stem 38. The stem 38 is hingedly connected to the gearing housing 14 at one end and integrally connected to the actuating portion 40 at the other. The actuating portion 40 extends partly into the cut-away portion 26.

The lever 36 and its interaction with drive force transmitting means 32 will now be described with reference to FIGS. 5 and 6.

As mentioned above, lever 36 is hingedly connected to the gearing housing 14. The hinged connection of the lever 26 is such that, in its closed position, the lever is flush with the side 28.

Connected to the interior facing side of the stem 38 is a first end of retaining strut 42. The other end of retaining strut 42 is anchored to the base side 44 Connected to the interior facing side of actuating portion 40 is a first end of actuating strut 46. The end of actuating strut 46 not connected to the actuating portion has a pin protruding therefrom.

The pin of the actuating strut 46 is adapted to be received within an aperture of a first cam protrusion 48 and a first aperture positioned in one end of a first connecting strut 50. The actuating strut 46 is made of a resilient material. The first cam protrusion 48 acts as a lever.

A second aperture is positioned at the other end of the first connecting strut 50. The first connecting strut 50 is arcuate in shape. The size of the first connecting strut 50 is substantially equal to the distance between the first cam protrusion 48 and a second cam protrusion 52.

A pin (not shown) disposed at a first end of a second connecting strut 54 is adapted to be received within an aperture provided in the second cam protrusion 52 and the second aperture of the first connecting strut 50. An additional pin, disposed at the other end of the second connecting strut 54, is adapted to be received within an aperture provided in a third cam protrusion 56. The second connecting strut 54 is linear in shape. The length of the second connecting strut 54 is substantially equal to the distance between the second cam protrusion 52 and the third cam protrusion 56.

The first cam protrusion 48 is integrally formed with a first cam extender 58. The second cam protrusion 52 is integrally formed with a second cam extender 60. The third cam protrusion 56 is integrally formed with a third cam extender 62. As cam extenders 58, 60, 62 are identical in construction, the following description of the first cam extender 58 will suffice to also explain the components of the second and third cam extenders 60, 62.

Cam extender 58 is cylindrical in shape. In the embodiment shown, two angular recesses 64 are provided within the cam extender 58. The interior of the cam extender 58 is adapted to receive a drive shaft 66 centrally therein.

Drive shaft 66 is of the same diameter as drive force transmitting means 32*c*, excepting base portion 68 which has a substantially larger diameter than that of the cam extender 58. A spring (not shown) of substantially similar diameter to the base portion 68 is positioned between the base portion 68 and the base side 44.

The two angular recesses 64 are adapted to receive a cover protrusion 70. The cover protrusion 70 comprises a cylinder 72 having two lugs 74 protruding therefrom. The cylinder 72 is received within the cam extender 58 such as to be interposed between the cam extender 58 and the drive shaft 66. The two lugs 74 are exact fits with the angular recesses 64 formed within the cam extender 58.

The cover protrusion 70 is integrally formed with the interior surface of side 24.

Figure 2:
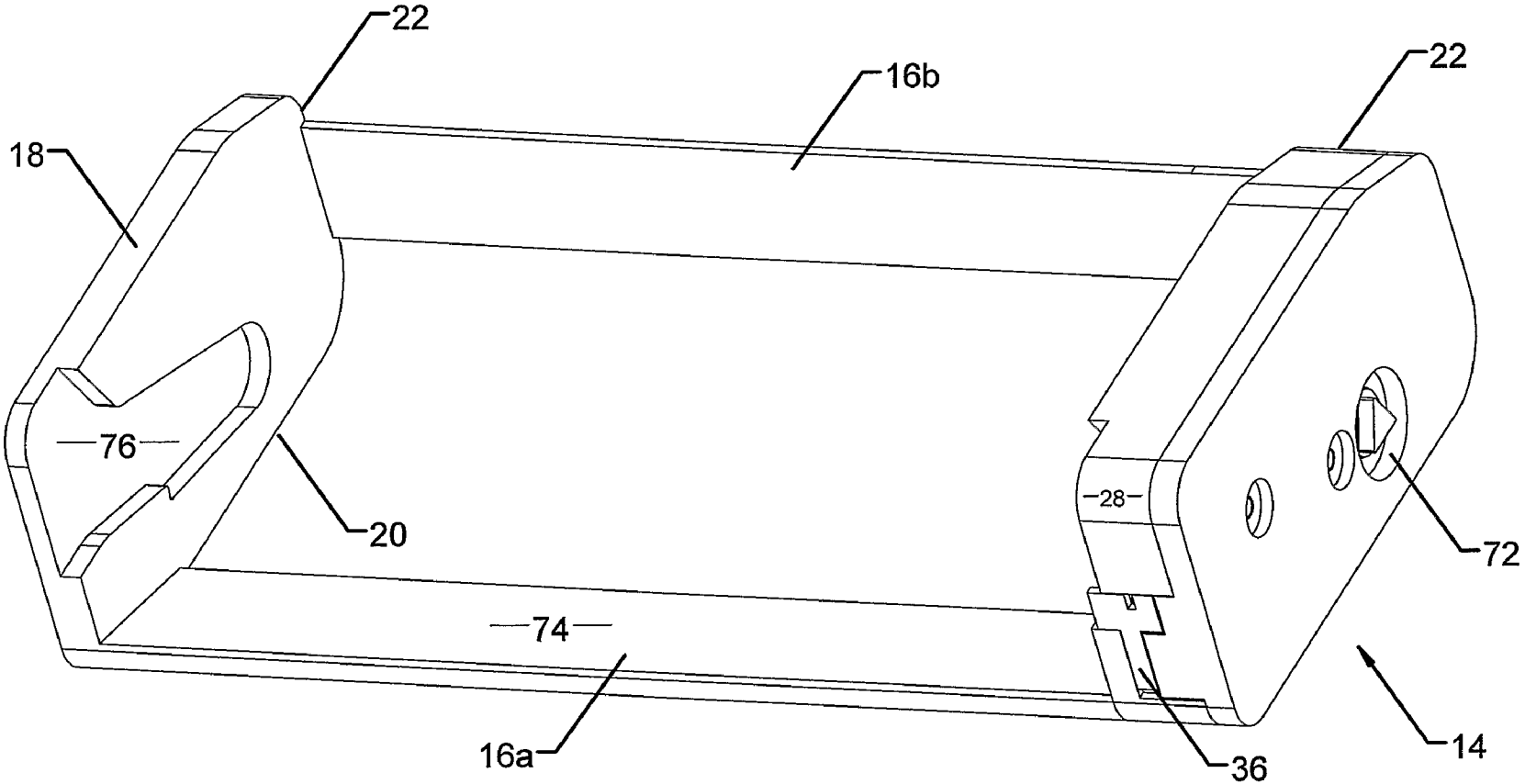
FIG. 2 is a second top isometric view of the removably mountable frame shown in FIG. 1.
Figure 3:
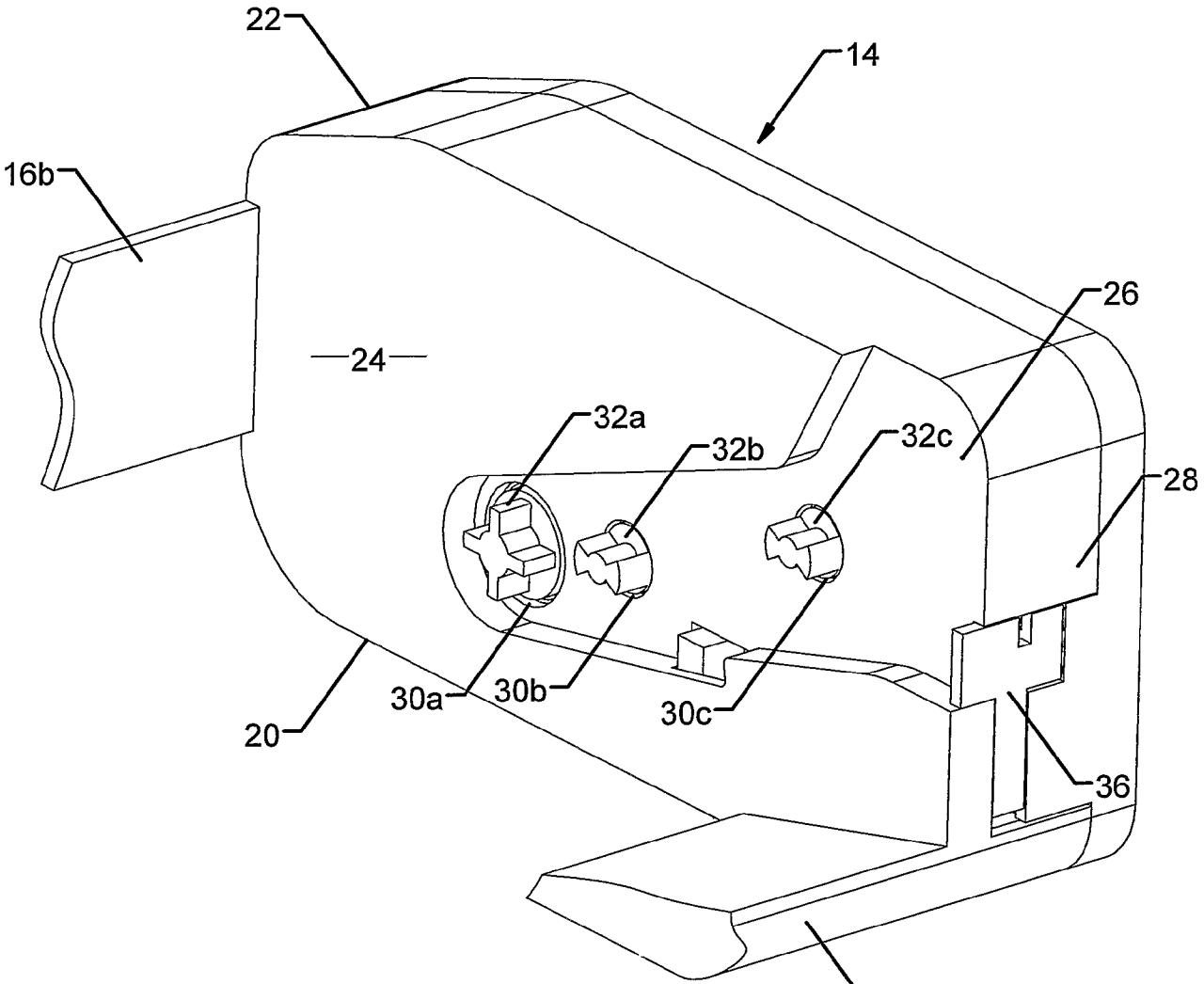
FIG. 3 is an isometric view of a gearing housing of the removably mountable frame shown in FIG. 1 with a lever positioned to a closed position.
Figure 4:
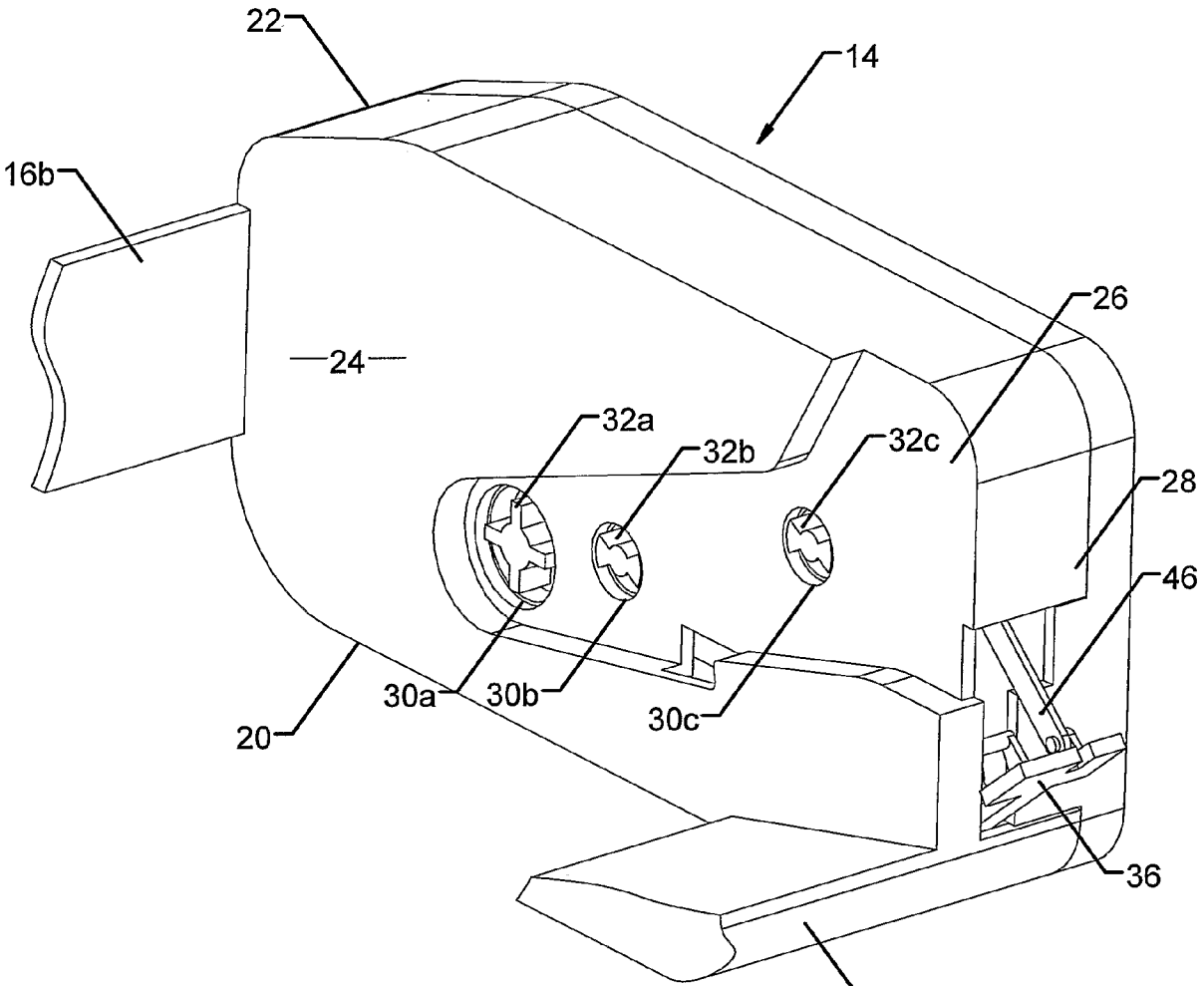
FIG. 4 is an isometric view of a gearing housing of the removably mountable frame shown in FIG. 1 with the lever position in an open position.

As shown in FIG. 2, on the side of the gearing housing 14 opposite aperture 26 is a driving force receiving member 72. The driving force receiving member 72 is adapted to engage a driving force transmitting member (not shown) within the image processing apparatus when the removably mountable frame 10 is retained therein.

In the embodiment shown, the driving force receiving member 72 is directly connected to the drive force transmitting means 32*a*. It should be appreciated that the manner in which the driving force may be transmitted from the driving force receiving member 72 to all driving force transmitting means 32 are many and varied and would not be beyond the person skilled in the art. For this reason, and for the sake of clarity, the mechanisms by which the driving force received by the driving force receiving member 72 is transferred to driving force transmitting means 32*b* and 32*c* have been omitted from the Figures.

Spacer 16*a* has a sloped internal face 74. The slope of the internal face 74 is uniform across the length of the spacer 16*a*. The slope of the internal face 74 has its highest point adjacent side 28.

Like gearing housing 14, side brace 18 also has a cut-away portion 76. The cut-away portion 76 of side brace 18 is a mirror image of the cut-away portion 26 of gearing housing 14.

Figure 7:
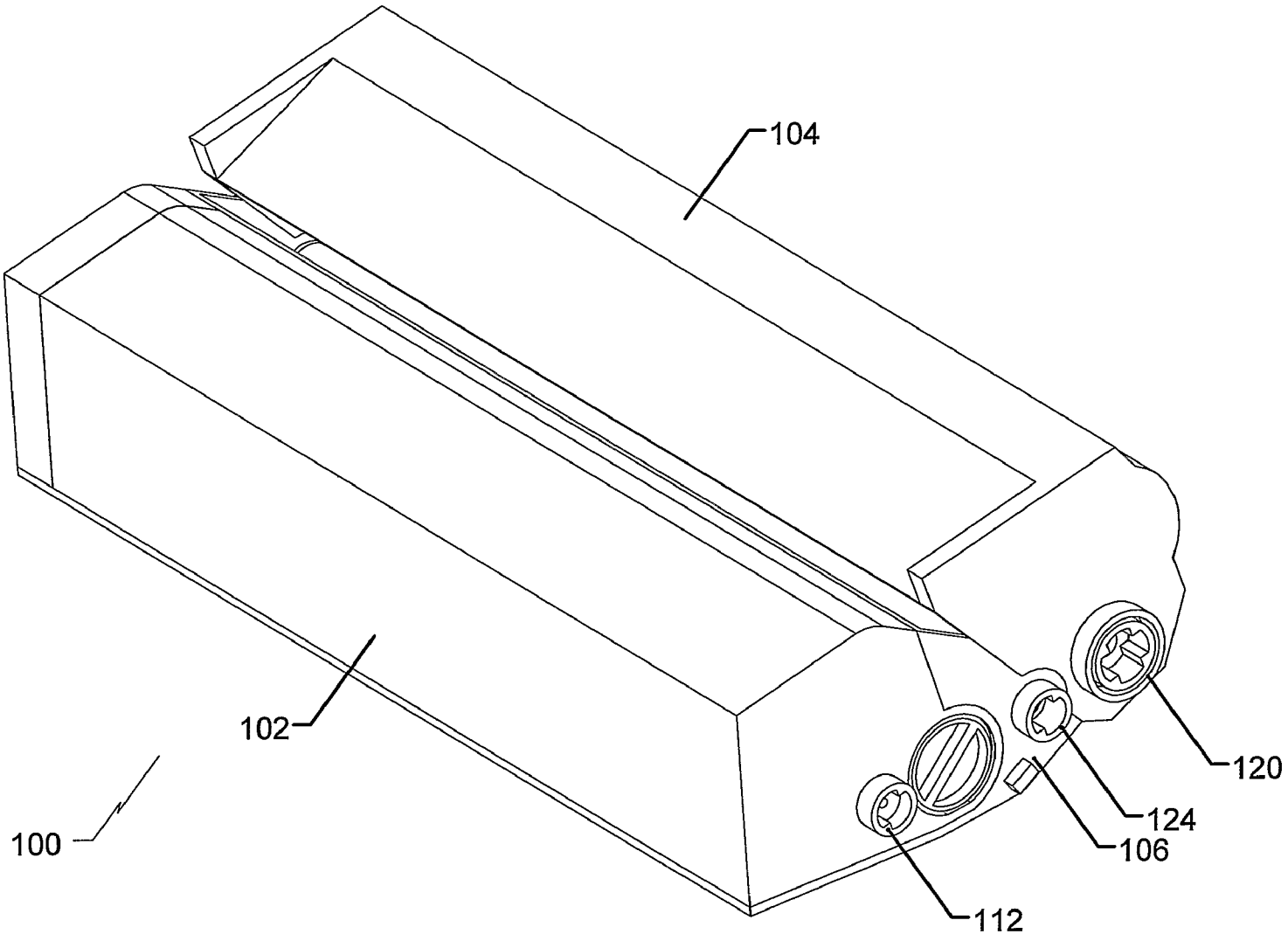
FIG. 7 is a top isometric view of a cartridge to a second embodiment of the invention adapted to be received within a removably mountable frame as shown in FIG. 1.
Figure 8:
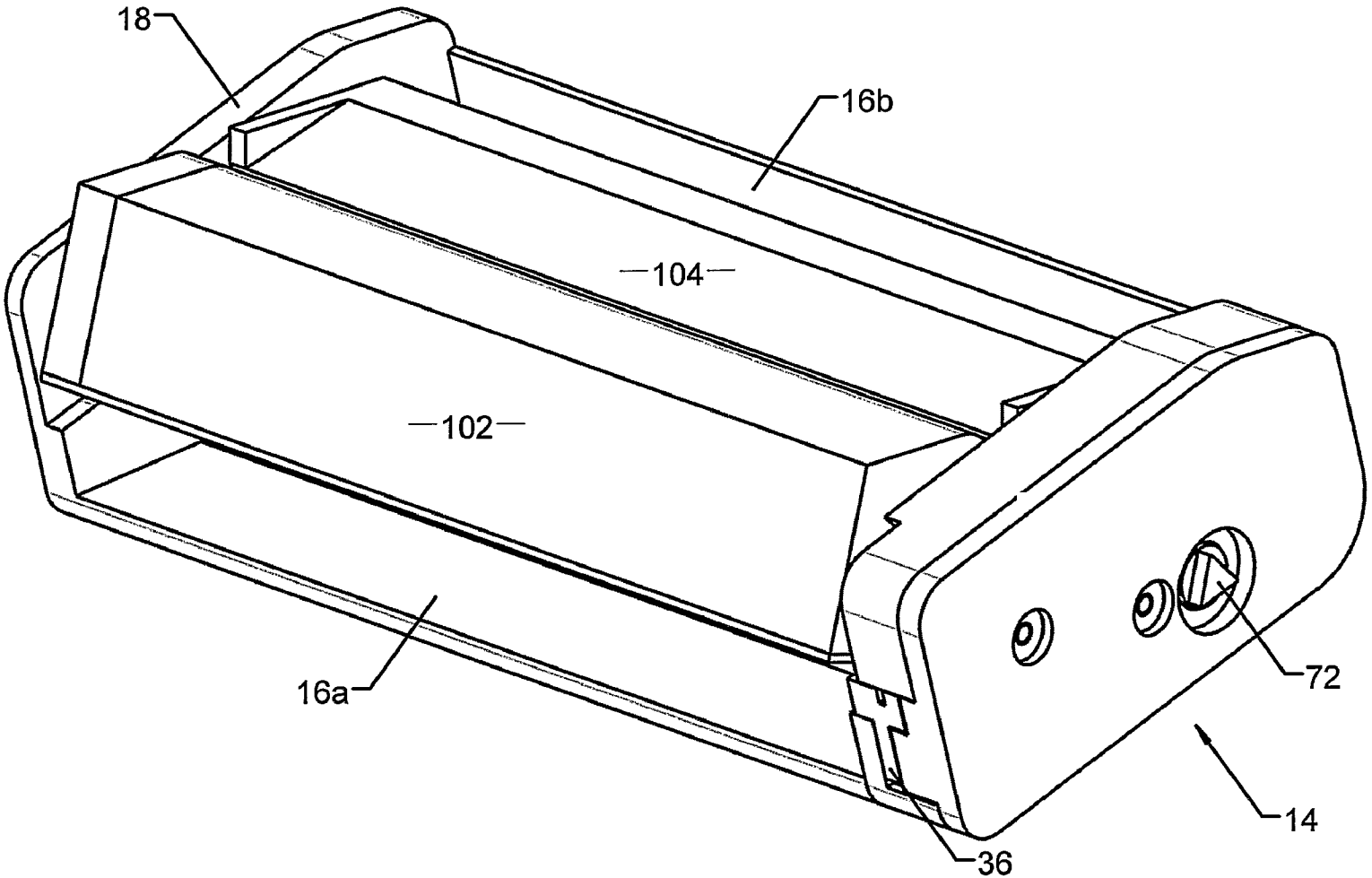
FIG. 8 is a top isometric view of the cartridge as shown in FIG. 7 as received within a removably mountable frame as shown in FIG. 1.
Figure 9:
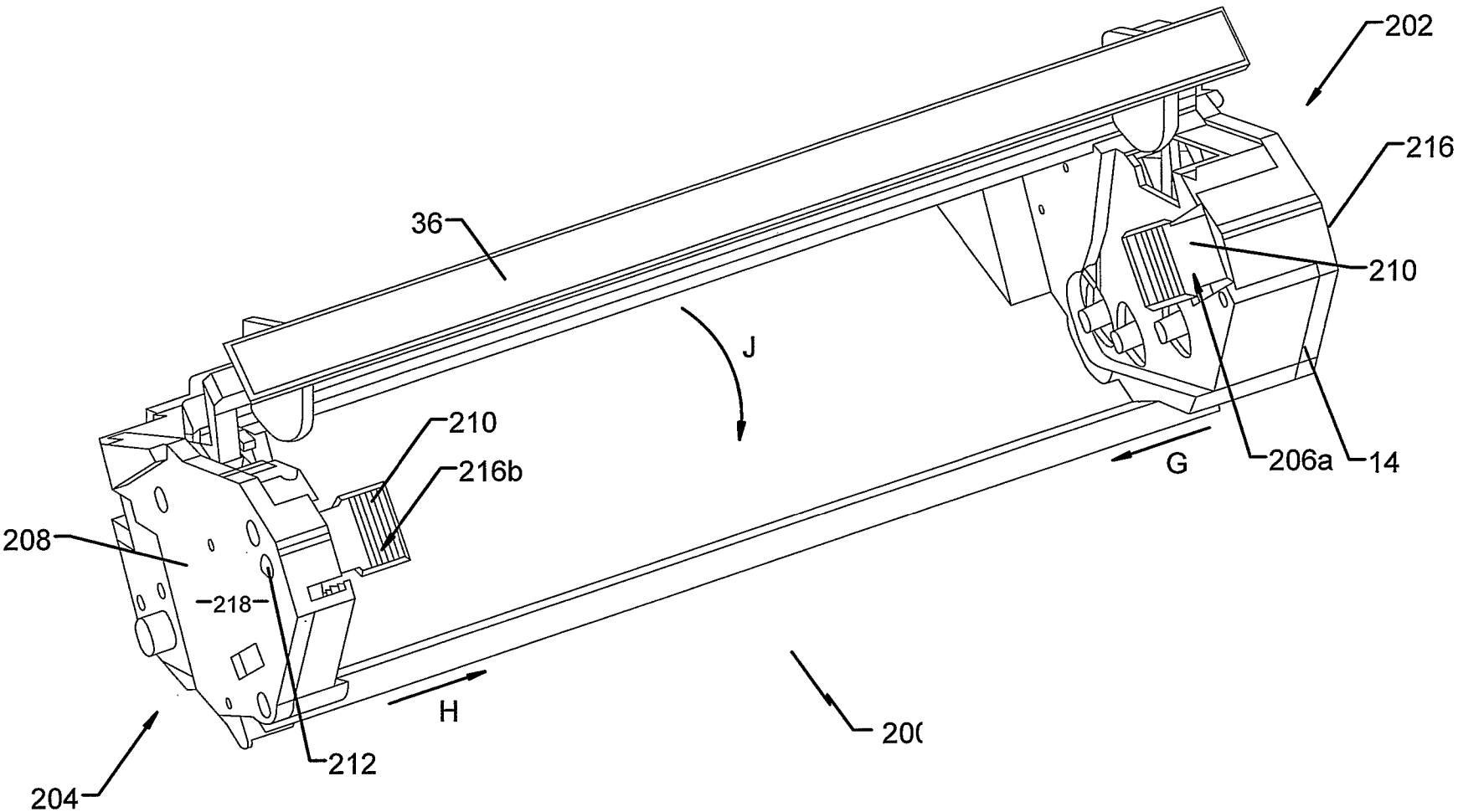
FIG. 9 is a top isometric view of a removably mountable frame according to a third embodiment of the invention with a lever positioned to an open position.

In accordance with a second embodiment of the invention there is a cartridge 100 adapted to be received within a removably mountable frame 10 as described in the first embodiment of this invention. The cartridge 100 is illustrated in FIGS. 7 through 9.

The cartridge 100 has a toner hopper 102, photosensitive drum housing 104 and a developer roller housing 106. The developer roller housing 106 is intermediate the toner hopper 102 and the photosensitive drum housing 104.

The toner hopper 102 stores toner for supply to a developer roller 108. The toner hopper 102 has an agitator 110 substantially positioned internally therein. The agitator 110 has a driving force receiving member 112 positioned externally adapted to receive the driving force transmitting member 32*c* when the cartridge 100 is received within the removably mountable frame 10. The toner hopper 102 also has a shutter cover 114 that extends longitudinally in parallel with the agitator 110 to prevent toner exiting the toner hopper 102 when not required to develop an image.

The photosensitive drum housing 104 houses a photosensitive drum 116 and a cleaning blade 118. The majority of the photosensitive drum 116 is positioned internally within the photosensitive drum housing 104. The portion of the photosensitive drum 116 positioned external to the photosensitive drum housing 104 forms a driving force receiving member 120. The driving force receiving member 120 is adapted to receive the driving force transmitting member 32*a* when the cartridge 100 is received within the removably mountable frame 10. One end of the cleaning blade 118 is in contact with the photosensitive drum 116 along its axial length to provide the required cleaning of the photosensitive drum 116.

The developer roller housing 106 houses the developer roller 122. The developer roller 122 is positioned substantially adjacent the shutter cover 114, such that toner exiting the toner hopper 102 via the opening protected by the shutter cover 114 can be dispersed along the axial length of the developer roller 122. Further, the distance between the developer roller 108 and the photosensitive drum 116 is uniform along their respective axial lengths. Like the photosensitive drum 116, the majority of the developer roller 108 is positioned internally within the developer roller housing 106. The portion of the developer roller 108 positioned external to the developer roller housing 106 forms a driving force receiving member 124. The driving force receiving member 124 is adapted to receive the driving force transmitting member 32*b* when the cartridge 100 is received within the removably mountable frame 10.

As is shown in FIG. 7, the cartridge 100 is completely enclosed with the exception of longitudinal aperture 126. The longitudinal aperture 126 forms part of the developer roller housing 106. This is better illustrated in FIG. 9.

The length of longitudinal aperture 126 is at least equal to the axial length of the photosensitive drum 116. The position and width of the longitudinal aperture are such that a light source (not shown), such as a laser, mounted within the image processing apparatus can ascribe an image onto the photosensitive drum 116 when the cartridge 100 is received within the removably mountable frame 10, which is in turn received within the image processing apparatus.

The first and second embodiments will now be described in the context of their normal use.

A user inserts the frame 10 into an image processing apparatus in the space in which the Original Equipment Manufacturer ("OEM") cartridge for the image processing apparatus normally resides. On insertion of the frame 10, and after resetting the image processing apparatus to its normally operable state, a driving force transmitting member of the image processing apparatus engages the driving force receiving member 72. In this manner, the driving force provided by the driving force transmitting member of the image processing apparatus is conveyed to the driving force transmitting members 32 of the frame 10.

Once the frame 10 has been inserted into the image processing apparatus, the user may then insert a cartridge 100 into the frame 10. To insert the cartridge, the user repositions the lever 40 to the open position by rotating the lever 40 towards him/her.

Rotating the lever 36 to the open position causes the actuating strut 46 to flex, while at the same time rotating cam protrusion 48 in a clockwise direction. Through the connecting struts 50 and 54, the same rotational movement in a clockwise direction is effected in respect of rotating cam protrusion 52 and rotating cam protrusion 56.

The rotation of cam protrusion 48 in a clockwise direction causes cam extender 58 to move towards the base side 44. This movement is assisted by the sloping edge of the angular recesses 64. When rotated the full extent provided for by actuating lever 46, the lugs 70 are completely disengaged from the angular recesses 64.

As the cam extender 58 moves towards the base side 44 it pushes against the base portion 68. This forces the base portion 68 to also move towards the base side 44 and, in doing so, compress a spring (not shown). Further, by moving the base portion 68 towards the base side 44, driving force transmitting member 32*c* moves to a recessed position within aperture 30*c*.

An identical situation occurs in respect of cam extenders 60 and 62.

With each driving force transmitting member 32 moved to a recessed position within their respective aperture 30, the user may now insert a cartridge 100. The cartridge 100 is guided into the correct position by the cut-away portions 26, 76. The cartridge is prevented from moving too far forward by spacer 16*b*. Spacer 16*a* operates to provide further guidance and support for the cartridge 100.

When the cartridge 100 has been inserted to the correct position within the frame 10, the user operates the lever 40 to the closed position. This is achieved by rotating the lever 40 back towards side 28.

The movement of the lever 40 to the closed position causes the actuating strut 46 to return to its normal position, while at the same time rotating cam protrusion 48 in a counter-clockwise direction. Through the connecting struts 50 and 54, the same rotational movement in a counter-clockwise direction is effected in respect of rotating cam protrusion 52 and rotating cam protrusion 56.

The rotation of cam protrusion 48 in a counter-clockwise direction causes cam extender 58 to move away from base side 44. This movement is assisted by the sloping edge of the angular recesses 64. When rotated the full extent provided for by actuating lever 46, the lugs 70 are completely received within the angular recesses 64.

As the cam extender 58 moves away from the base side 44, the compression of the spring lessens, this forces the base portion 68 up against the cam extender 58. In turn, this moves the driving force transmitting member 32*c* out from its recessed position within aperture 30*c*. When the cam extender 58 has moved away from the base side 44 the maximum distance possible (ie. When the lugs 70 are completed received within the angular recesses 64), the driving force transmitting member 32*c* is able to engage the driving force receiving member 112 of the cartridge 100.

An identical situation occurs in respect of cam extenders 60 and 62 whereby engagement is formed between driving force transmitting members 32*a* and 32*b*, respectively, and their corresponding driving force receiving member 120, 124.

When each driving force transmitting member 32 is engaged with its corresponding driving force receiving member 112, 120, 124, the cartridge 100 is securely locked in place and further stability is provided to the cartridge 100 through spacers 16 and side brace 18. In this position, driving force provided by the driving force transmitting means provided for in the image processing means is transferred to driving force receiving means 112, 120, 124 by way of the mechanisms provided for in the gear housing described above.

In accordance with a third embodiment of the invention there is a removably mountable adaptor for use in an image processing apparatus (not shown). The removably mountable adaptor comprises:

a gearing housing;

a support brace

The gearing housing and support platform are integrally connected at right angles to each other. The gearing housing has a cut-away portion on the side to which the support brace is connected. The cut-away portion is tapered at one end.

Positioned within the cut-away portion are three apertures. The apertures are adapted to receive drive force transmitting means.

In this embodiment being described, the drive force transmitting means take the form of a cog having a cylindrical main shaft with four equidistant box-shaped teeth disposed thereabout.

The gearing housing also has a lever attached thereto. The lever comprises an actuating portion and a stem. The stem is hingedly connected to the gearing housing at one end and integrally connected to the actuating portion at the other. The actuating portion extends partly into the cut-away portion.

Figure 5:
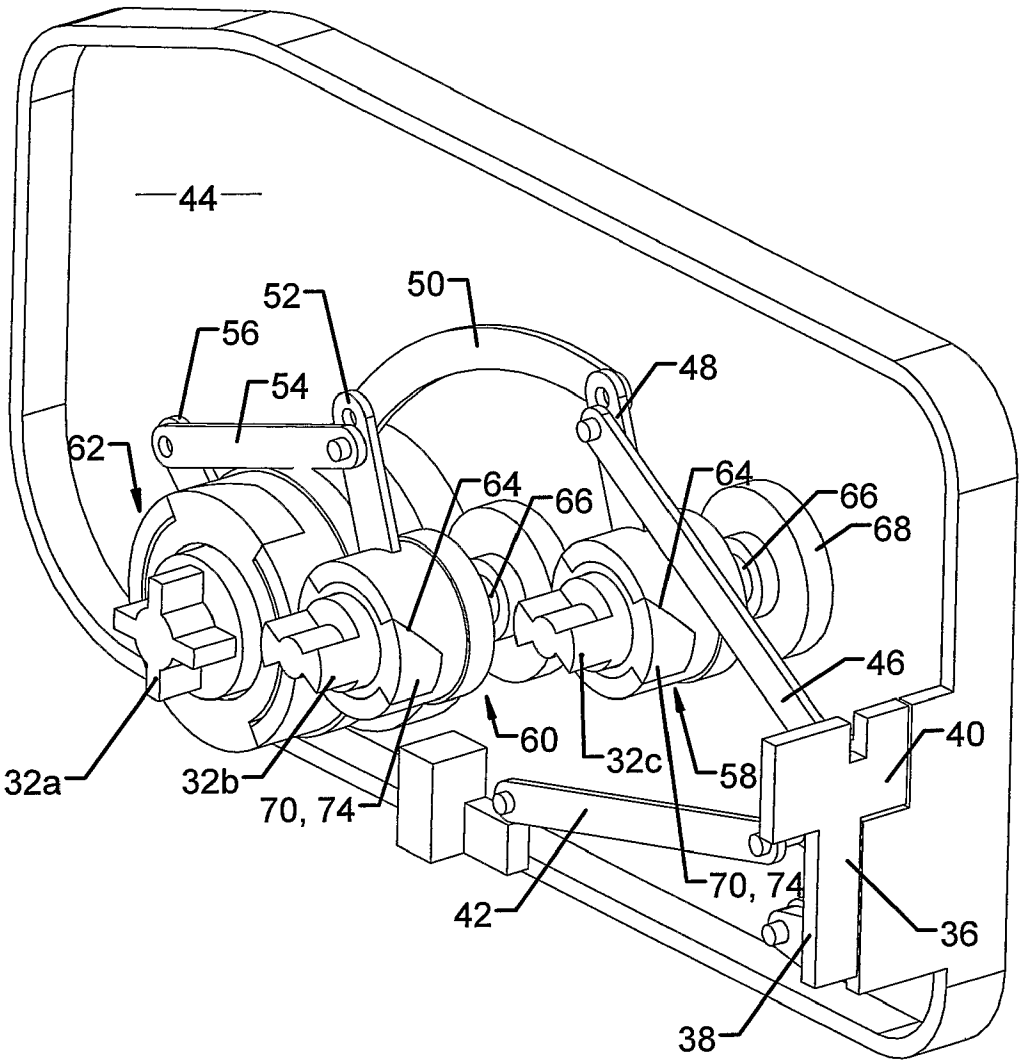
FIG. 5 is an identical view to that shown in FIG. 3, but with a cover of the gearing housing removed.
Figure 6:
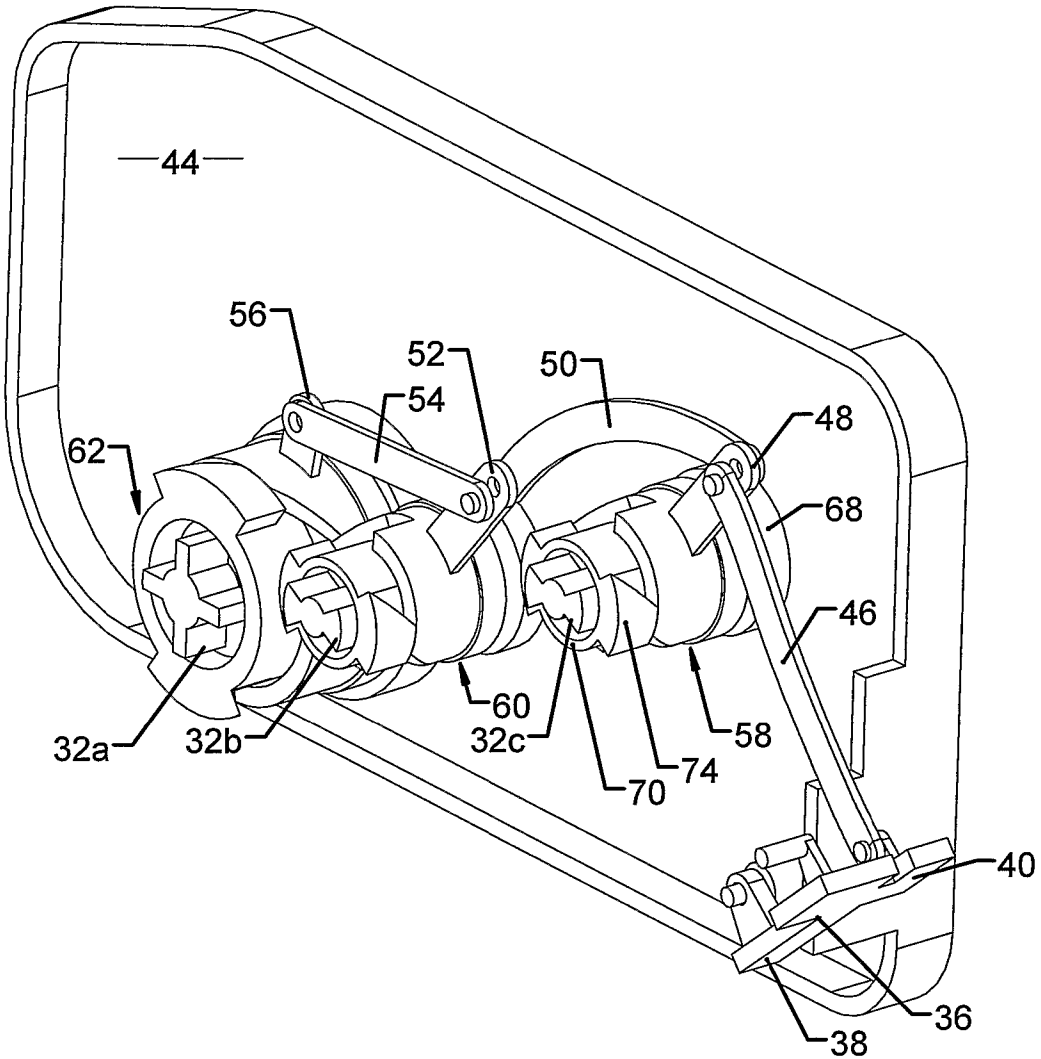
FIG. 6 is an identical view to that shown in FIG. 4, but with a cover of the gearing housing removed.

The lever and its interaction with drive force transmitting means is the same as that shown in FIGS. 5 and 6. As the interaction between the lever and the drive force transmitting means has already been described in the context of the first embodiment, and the interaction between these components is the same for this the third embodiment, the interaction will not be described again here. For the same reasons, the interaction between a driving force receiving member positioned on the side of the gearing housing opposite the side to which the support brace is connected and the driving force transmitting members will also not be described here.

The support brace acts as a flange. The portion of the support brace that protrudes from the gearing housing, extends to cover only a portion of the underside of a cartridge that the adaptor mates with. The support brace may have a groove or protrusion provided therein to further facilitate the mating of the cartridge with the adaptor and to provide stability for the overall mated configuration.

In accordance with a fourth embodiment of the invention there is a cartridge adapted to be received within a removably mountable adaptor as described in the third embodiment of this invention.

The removably cartridge has a toner hopper, photosensitive drum housing and a developer roller housing. The developer roller housing is intermediate the toner hopper and the photosensitive drum housing.

The toner hopper stores toner for supply to a developer roller. The toner hopper has an agitator substantially positioned internally therein. The agitator has a driving force receiving member positioned externally adapted to receive a driving force transmitting member when the cartridge is received within the removably mountable adaptor. The toner hopper also has a shutter cover that extends longitudinally in parallel with the agitator to prevent toner exiting the toner hopper when not required to develop an image.

The photosensitive drum housing houses a photosensitive drum and a cleaning blade. The majority of the photosensitive drum is positioned internally within the photosensitive drum housing. The portion of the photosensitive drum positioned external to the photosensitive drum housing forms a driving force receiving member. The driving force receiving member is adapted to receive a driving force transmitting member when the cartridge is received within the removably mountable adaptor. One end of the cleaning blade is in contact with the photosensitive drum along its axial length to provide the required cleaning of the photosensitive drum.

The developer roller housing houses the developer roller. The developer roller is positioned substantially adjacent the shutter cover, such that toner exiting the toner hopper via the opening protected by the shutter cover can be dispersed along the axial length of the developer roller. Further, the distance between the developer roller and the photosensitive drum is uniform along their respective axial lengths. Like the photosensitive drum, the majority of the developer roller is positioned internally within the developer roller housing. The portion of the developer roller positioned external to the developer roller housing forms a driving force receiving member. The driving force receiving member is adapted to receive a driving force transmitting member when the cartridge is received within the removably mountable adaptor.

The cartridge is completely enclosed with the exception of two longitudinal apertures. The longitudinal apertures forms part of the developer roller housing. The length of each longitudinal aperture is at least equal to the process width of the photosensitive drum. The position and width of the first longitudinal aperture are such that an image forming member mounted within the image processing apparatus can ascribe an image onto the photosensitive drum along its process width when the cartridge is received within the removably mountable frame, which is in turn received within the image processing apparatus. The position and width of the second longitudinal aperture are such that when the cartridge is received within the image forming apparatus, the image ascribed on the photosensitive drum can be conveyed to a transfer medium by way of the second longitudinal aperture.

In accordance with a fifth embodiment of the invention there is a removably mountable frame substantially as described within the first embodiment of the invention. However, unlike in the first embodiment, where the drive force transmitting means 32 are adapted to co-axially engage drive force receiving members 112 of a cartridge 100, in this embodiment each driving force transmitting means 32 has a gear at its exposed ends. This gear is adapted to engage, in a non-co-axial manner, with at least one similar gear provided for as part of the drive force receiving member 112 of the cartridge 100 to which it is designed to be engaged.

In this configuration, when the lever 36 is set to the open position, the drive force transmitting means 32 retract at least partially into the housing, but sufficient so as to disengage the gear of the drive force transmitting means 32 from the gears of the drive force receiving member 112. Alternatively, when the lever 36 is set to the closed position, the drive force transmitting means 32 protrudes from the housing sufficiently such that the gear of the drive force transmitting means 32 engages at least one gear of the drive force receiving member 112. Once so engaged, as rotational force is applied to the drive force transmitting means 32 such rotational force is transferred to the drive force receiving member 112 by the engagement of their respective gears.

In accordance with a sixth embodiment of the invention there is a removably mountable frame 200 substantially as described in the first embodiment of the invention. However, in this sixth embodiment the lever 36 is modified as will be described below.

As shown in FIG. 9, lever 36 extends between a main housing end 202 (corresponding to gearing housing 14) and an opposing housing end 204. The lever 36 takes the form of an elongated, inverted "U" shaped switch. The ends of the lever 36 which is received within main housing end 202 is appropriately linked to the retaining strut 44 or actuating strut 46, as appropriate.

The additional benefits provided by this type of lever 36 will be discussed in more detail in the context of its intended use.

This sixth embodiment of the invention also includes frame locking mechanisms 206 for securely retaining the removably mountable frame 200 to an image processing apparatus (not shown). Frame locking mechanism 206*a* forms part of the gearing housing 14. Frame locking mechanism 206*b* forms part of the opposing housing 208.

Each frame locking mechanism 206 consists of a rotatable tab 210, a locking pin 212 and a spring (not shown). The rotatable tab 210 is able to rotate between an engaged position and an obstructing position.

The locking pin 212 has exposed ends 214. Each exposed end 214 is of smaller diameter than the diameter of the main body of the locking pin 212. The length of the main body of the locking pin 212 is also less than the width of the gearing housing 14 or opposing housing 208, as appropriate.

In respect of frame locking mechanism 206*a*, the spring encircles the portion of an exposed end 214 located within the gearing housing 14 adjacent outermost side 216. In this manner, locking pin 212 is biased in direction G, so that the other exposed end 214 protrudes out from the gearing housing 14.

Figure 11:
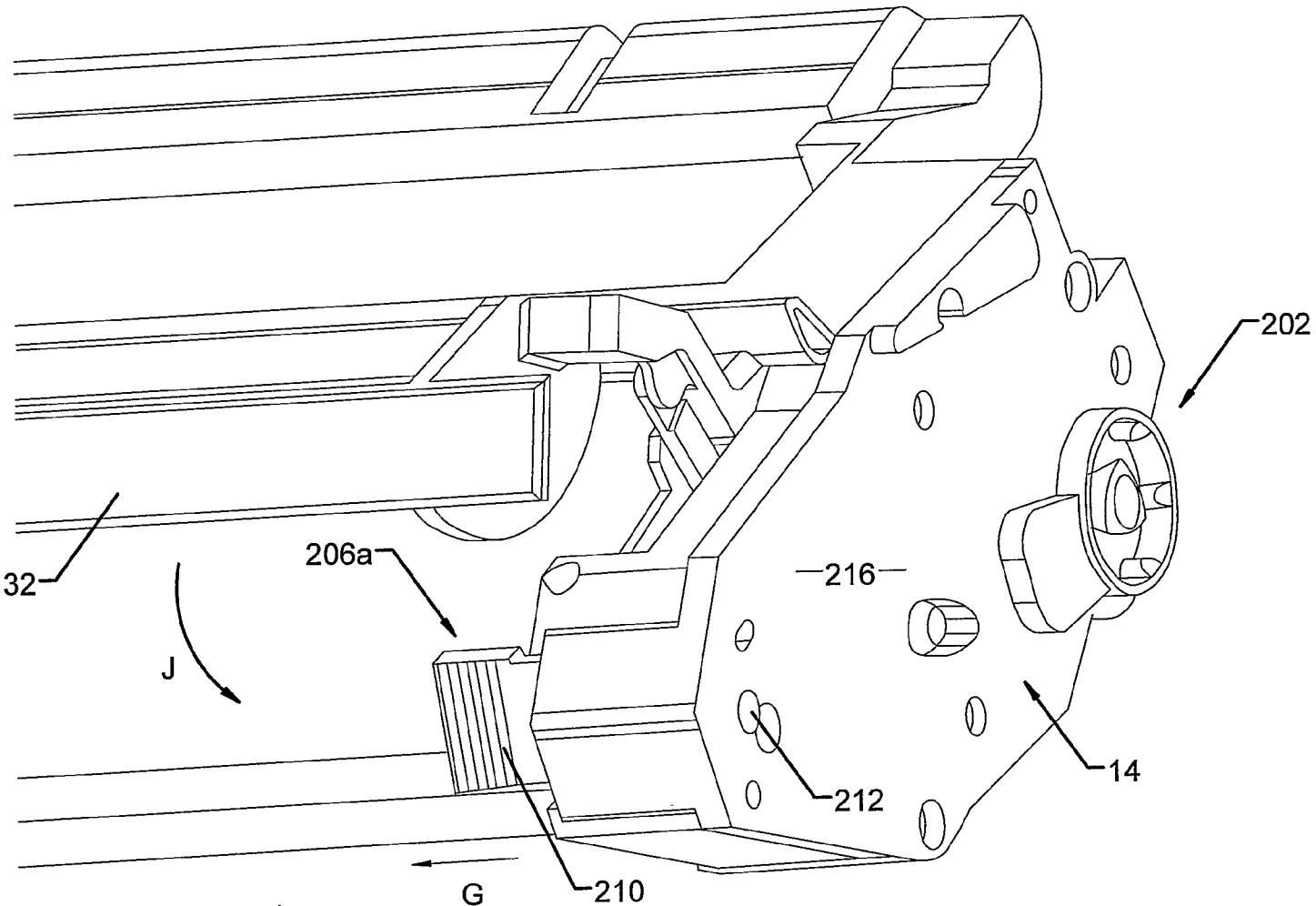
FIG. 11 is a partial isometric view of a removably mountable frame as shown in FIG. 9, with a frame locking mechanism set to an open position.
Figure 12:
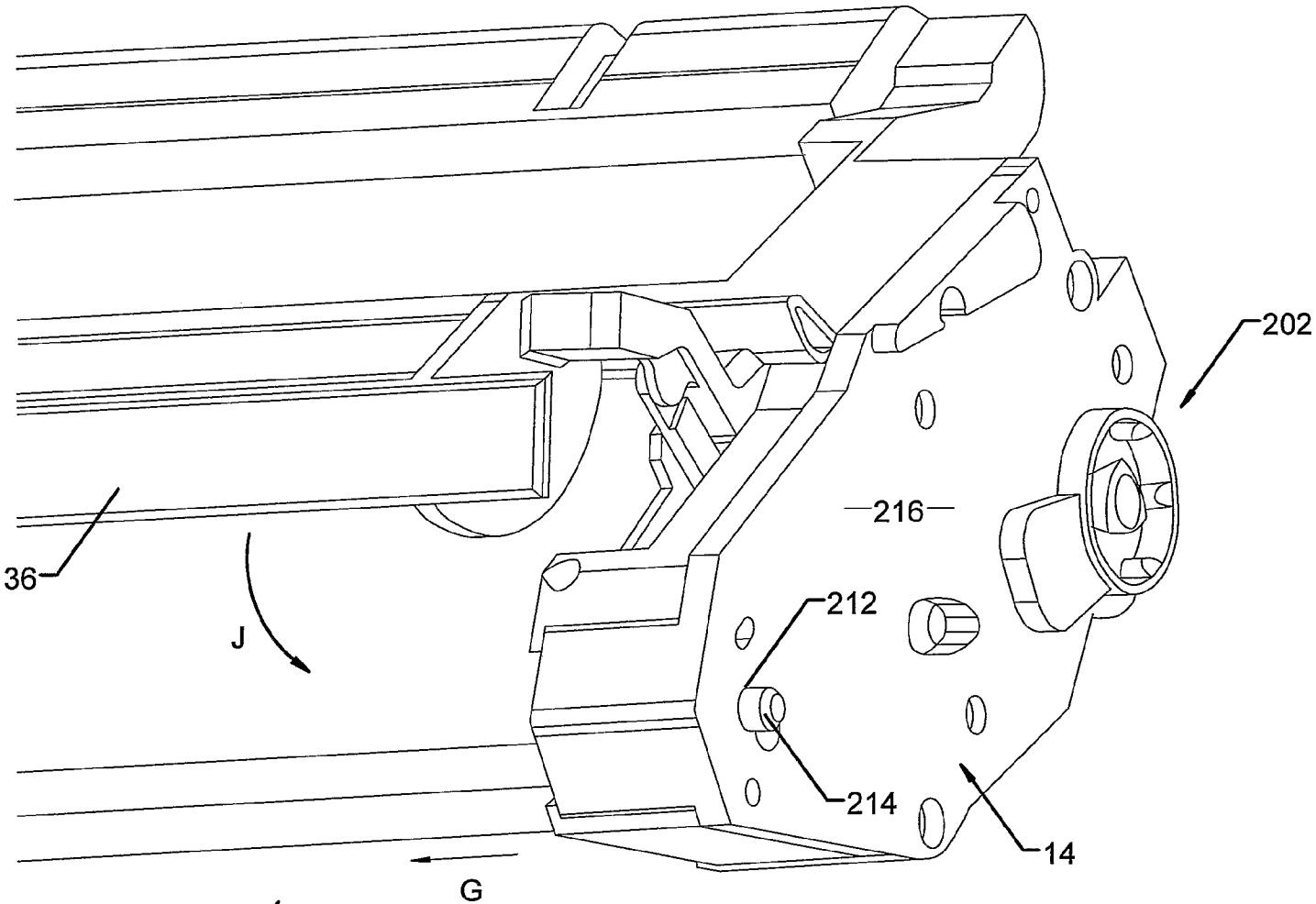
FIG. 12 is a first partial isometric view of the removably mountable frame as shown in FIG. 9, with a frame locking mechanism set to a closed position.
Figure 13:
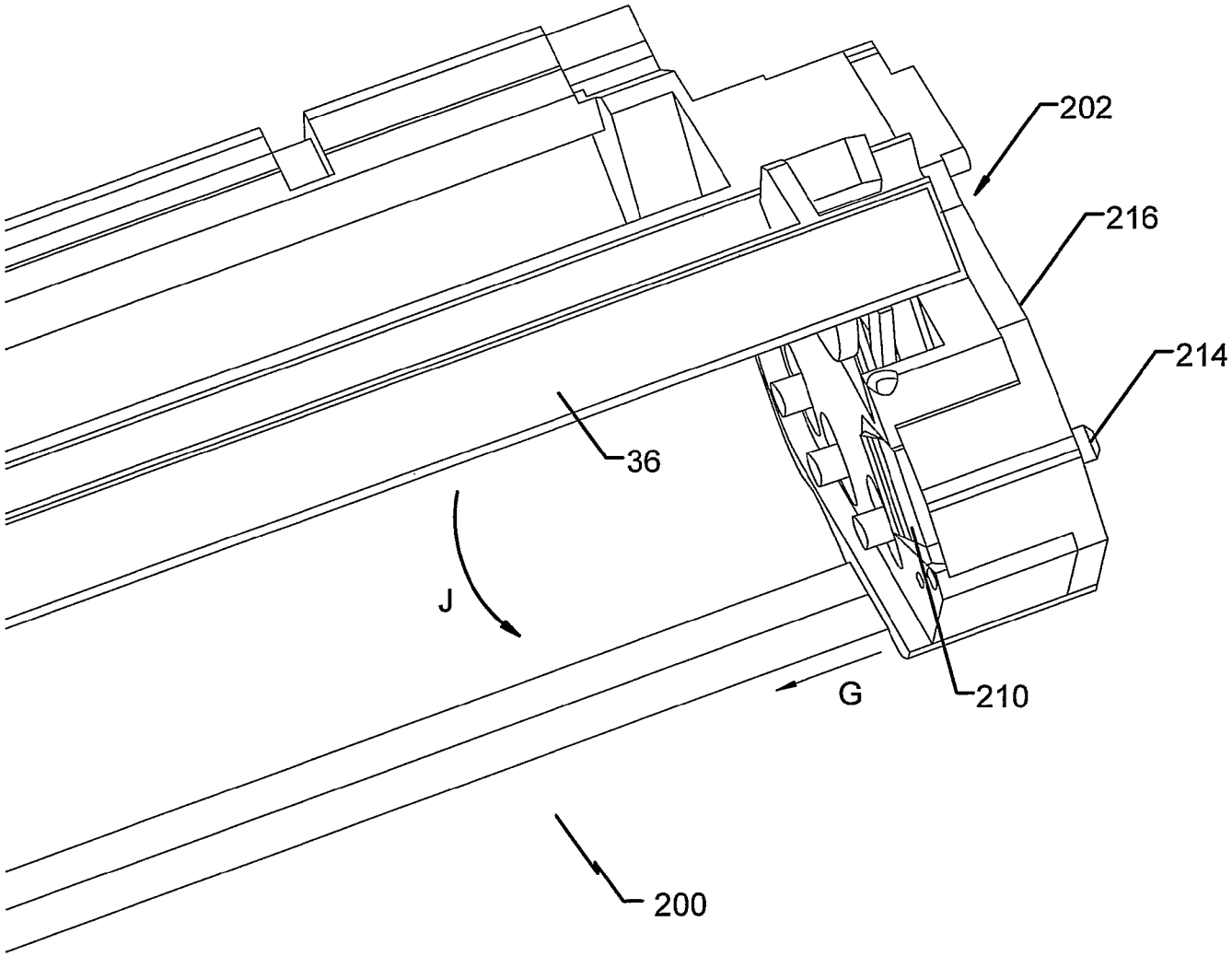
FIG. 13 is a second partial isometric view of the removably mountable frame as shown in FIG. 9, with a frame locking mechanism set to a closed position.

In respect of frame locking mechanism 206*b*, the spring encircles the portion of an exposed end 214 located within the opposing housing 208 adjacent the outermost side 218. In this manner, locking pin 212 is biased in direction H, so that the other exposed end 214 protrudes out from the opposing housing 208. See also FIGS. 11 to 13.

By biasing the respective locking pins 212 in this manner, the locking pins 212 prevent the rotatable tabs 210 from being set to the engaged position without force being applied thereto. This force is typically overcome when the user installs cartridge 100 into the frame 200.

This embodiment will now be described in the context of its intended use.

By installing the cartridge 100 into the frame, the cartridge 100 moves both rotatable tabs 210 from their obstructing position (or somewhere between the obstructing position and the engaged position) to its engaged position. The presence of the cartridge 100 then overcomes the bias applied to the locking pins 212 and thereby causes an exposed end 214 of the locking pin 212 of frame locking mechanism 206*a* to project out from outermost side 216. At the same time, this causes an exposed end 214 of the locking pin 212 of frame locking mechanism 206*b* to project out from outermost side 218.

In this configuration, if the user installs the cartridge 100 into the frame 200 while the frame 200 is not received within an image forming apparatus, the combined frame 200 and cartridge 100 is thereafter unable to be securely received within the image processing apparatus—the projecting exposed ends 214 preventing appropriate insertion and engagement of the frame 200 with the interior components of the processing apparatus. In this manner, the resistance provided by the exposed ends 214 as it is obstructed by the interior components of the image processing apparatus provides a warning to the user that further insertion of the combined frame 200 and cartridge 100 may cause damage to the image processing apparatus.

This is also required as the design is such that when the frame 200 has a cartridge 100 received therein and is set to the appropriate position, removal of the frame 200 thereafter is prevented by the projecting exposed ends 214 abutting an interior component of the image processing apparatus. This also means that during insertion the exposed ends 214 must be retracted until the cartridge 100 is placed in such appropriate position—thereby requiring the user to install the cartridge 100 into the frame 200 after the frame 200 has been installed in the image processing apparatus.

Figure 10:
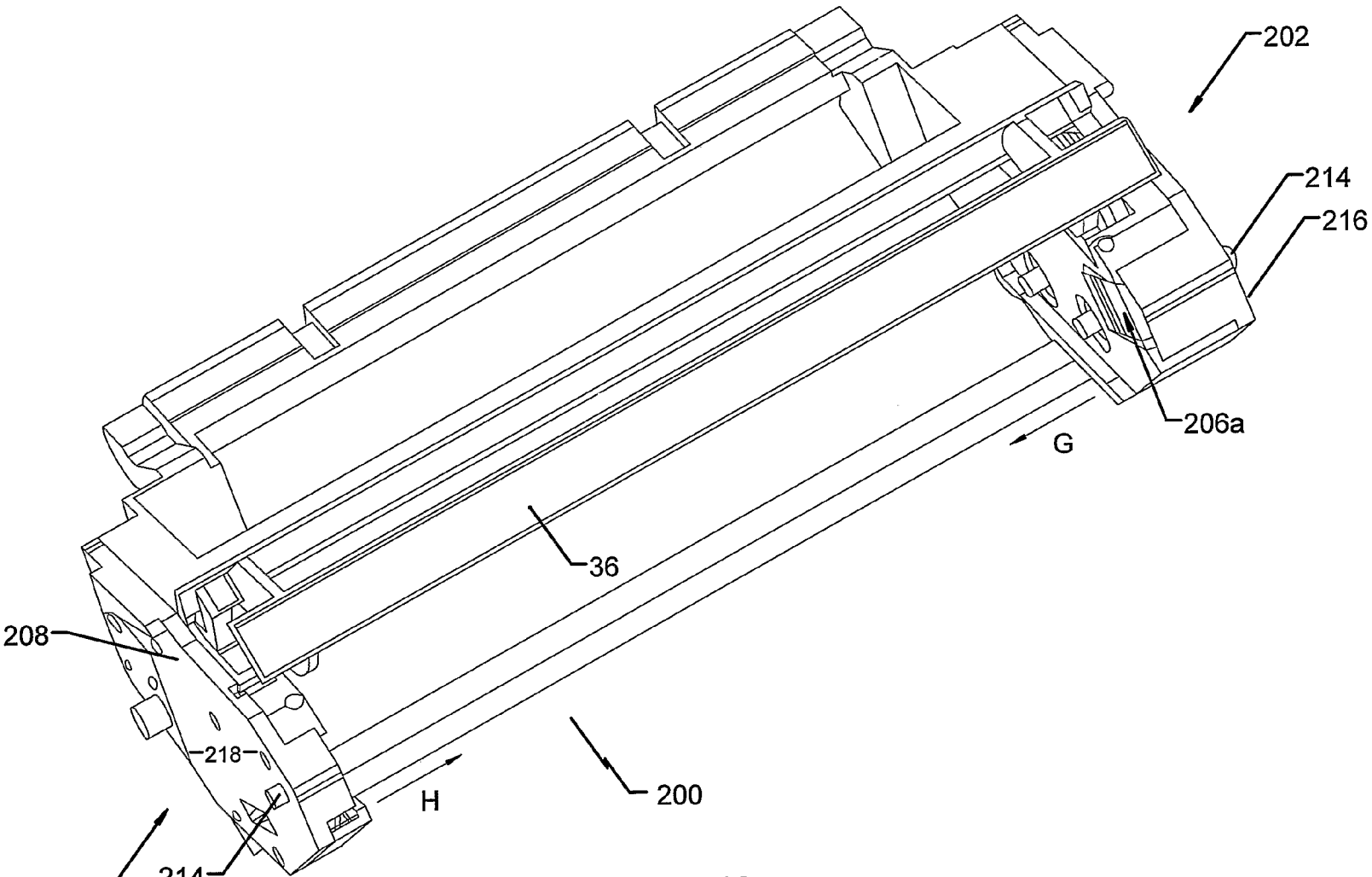
FIG. 10 is a top isometric view of a removably mountable frame as shown in FIG. 9, but with the lever positioned to a closed position.

With the frame 200 correctly installed in the image processing apparatus, and a cartridge 100 installed in the frame 200 so as to lock the frame 200 to the image processing apparatus, the user thereafter rotates in direction J the lever 36 from the position shown in FIG. 9 to the position shown in FIG. 10. This causes the driving force transmitting means 32 to engage with the appropriate driving force receiving members 112 of the cartridge 100 in the manner as described above in respect of the first embodiment of the invention.

At the same time, the presence of the lever 36 acts as a physical deterrent and/or reminder to the user not to forcibly remove the cartridge 100 from the frame 200. In this manner, the user is warned off physically damaging the frame 200 and/or the cartridge 100.

It should be appreciated by the person skilled in the art that the above embodiments are not limited to the features described above and that modifications and substitutions can be made without departing from the scope of the invention. For example:

- The external profile of the frames 10 may vary to match the internal configuration of the image processing apparatus to which it is adapted to be received. In such situations, taking into account the profile of the combined frame 10 and cartridge 100 when received within the image processing apparatus, the profile of the portions of the frame 10 that engage the cartridge 100 may be standardised. The external profile of the adaptor and its respective cartridge must similarly be configured.
- The positions of the gearing housing 14 and side brace 18 may be transposed where appropriate, with changes being made to the gearing housing 14 as needed, to facilitate receipt of driving force from either the left or right side of the image processing apparatus.
- The cut-away portions 26, 76 may be omitted. Alternatively, the cut-away portions 26, 76 may be replaced with guiding protrusions to facilitate correct alignment between the driving force transmitting members 32 and the driving force receiving members 120.
- A locking mechanism may be installed within the cut-away portion 26. The locking mechanism may be adapted to engage the cartridge 100 at the same time as the driving force transmitting members 32 engage driving force receiving members 120. Alternatively, the locking mechanism may engage the cartridge 100 prior to the driving force transmitting members 32 engaging the drive force receiving members 120.
- The number of drive force transmitting means 32 may be increased or decreased from the three shown in the accompanying figures. The number of drive force receiving means 120 ideally matches the number of drive force transmitting means 32.
- The drive force transmitting means 32 used may take on a different configuration to those described in this specification. For instance the drive force transmitting means 32 may be a twisted triangular projection or simply a rectangle. In any event, each driving force receiving means 120 must be configured such that it can receive driving force from its corresponding driving force transmitting means 32. Similarly, the driving force receiving means may take on alternative configurations to the one described or could be reversed (such that the configuration shown for the driving force receiving means 120 is implemented as the configuration for the driving force transmitting means 32 and vice-versa).
- The lever 36 configuration described above may be replaced with a push-button or switch configuration, provided that appropriate changes to the configuration of the actuating strut 46 are made to ensure that depression of the push-button or toggling the switch causes the desired change in state of the cam extenders 58, 60, 62. Alternatively, the lever 36 configuration may be varied to other forms not described herein.
- The driving force receiving means may not be directly connected to a driving force transmitting means as described in the first embodiment. Instead, the driving force receiving means may operate independently of the driving force transmitting means—the driving force received then being transmitted to the driving force transmitting members 32 by way of other gearing mechanisms. Alternatively, the driving force receiving means may be directly connected to a driving force transmitting means 32 other than driving force transmitting means 32*a*.
- The external shape of the cartridges may vary from the configuration shown in the accompanying figures. The only constraints on the configuration of the cartridges is that it must be shaped such that the driving force receiving members 120 can properly receive the driving force transmitting members 32 and be received within the image processing apparatus, and that an opening must be provided for in the cartridges at an appropriate position to allow the image forming member of the image processing apparatus to ascribe an image onto the photosensitive drum 116.
- The toner hopper 102 may be a separate component adapted to be removed from the remainder of the cartridge 100 and thereby replaced as required. In such a situation, the cartridge 100 may be further configured to only allow the toner hopper 102 replaced a certain number of times before being rendered inoperable.
- The toner hopper 102 may have an outlet provided therein. The outlet operable to facilitate resupply of toner to the toner hopper.
- The cartridges may have additional components to those described above incorporated therein. For example, the cartridges may be further adapted to include such components as a supply roller, triboelectric blade and scavenger unit.
- Electrodes may be provided on the cartridges or the frame 10 or the adaptor to facilitate the transfer of electrical power from the image processing apparatus to the cartridges, frame 10 or adaptor, as appropriate.
- A micro-processor may be provided for in the cartridge or the frame 10 or the adaptor to facilitate the exchange of prescribed information relating to the present cartridge (for example, information relating to the level of toner in the toner hopper 102). Ideally, the micro-processor is provided for the frame 10 or the adaptor.
- The longitudinal aperture 126 may be positioned in the photosensitive drum housing 104 rather than the developer roller housing 106.
- The longitudinal apertures 126 may each be shielded by a retractable cover. The retractable cover operable to protect the photosensitive drum 116 from external light when not received within the image processing apparatus and operable to expose the photosensitive drum 116 to external light when received within the image processing apparatus.

Interfaces required to initiate or facilitate the performance of certain functions within the image processing apparatus may be provided for on, or form part of the configuration of, the frame 10 or adaptor or cartridges.

The third and sixth embodiments of the invention may be adapted to use the gear engaging system described in the fifth embodiment of the invention.

The spring of the locking mechanism may be removed. However, in this situation there is increased difficulty in removing the frame from the image processing apparatus when required.

The system by which the drive force transmitting means 32 move to engage the driving force receiving member 124 may be other than described above. For instance, the drive force transmitting means 32 may be attached to a spring such that when the lever 36 is set to a first position, the driving force transmitting means 32 is moved in a first direction to a position where the spring is able to urge the driving force transmitting means to the driving force receiving member 124. In this configuration, when the lever 36 is set to the second position, the driving force transmitting means 32 moves in a reverse direction where the profile of either the driving force transmitting means 32 or the gearing housing 14 causes the driving force transmitting means 32 to compress the spring at least partially and allow for disengagement of the driving force transmitting means 32 from the driving force receiving member 124. Ideally, this movement in the reverse direction also causes the driving force transmitting means 32 to retract into the gearing housing 14.

It should further be appreciated by the person skilled in the art that the features described above, where not expressly indicated to the contrary, are not mutually exclusive and that a combination of features described may be produced to form yet further embodiments of the invention.

We claim:

1. A removably mountable frame comprising:

a driving force receiving means adapted to engage a driving force transmitting means of an image processing apparatus when the removably mountable frame is received within the image processing apparatus; and at least one frame driving force transmitting means, each frame driving force transmitting means adapted to co-axially engage corresponding cartridge driving force receiving means of a cartridge when the cartridge is engagedly received within the removably mountable frame, wherein the external configuration of the removably mountable frame when the cartridge is received therein is adapted to be received within the image processing apparatus and wherein the driving force receiving means adapted to engage a driving force transmitting means of an image processing apparatus is further adapted to transfer driving force applied thereto to each of the at least one frame driving force transmitting means.

2. A removably mountable frame according to claim 1, where, when a cartridge release means is set to a first position, the at least one frame driving force transmitting means disengage the cartridge driving force receiving means and at least partially retracts into a housing and where, when the cartridge release means is set to a second position, the at least one frame driving force transmitting means at least partially projects from the housing to co-axially engage the corresponding cartridge driving force receiving means.

3. A removably mountable frame according to claim 2, where the cartridge release means is one of the following: a lever; a switch; or push-button.

4. A removably mountable frame according to claim 1, where the driving force receiving means adapted to engage a driving force transmitting means of an image processing apparatus is directly connected with one of the at least one frame driving force transmitting means.

5. A removably mountable frame according to claim 1, further including struts and/or braces to provide support for the cartridge when received therein.

6. A removably mountable frame according to claim 1, further including recesses or cut-away portions within the frame to facilitate correct receipt of the cartridge within the removably mountable frame.

7. A removably mountable frame according to claim 1, where ridges or protrusions extend from the frame to facilitate correct receipt of the cartridge.

8. A removably mountable frame according to claim 1, further comprising a locking mechanism to securely connect the removably mountable frame to the image processing apparatus and maintain the frame's position within the image processing apparatus.

9. A removably mountable frame according to claim 8, where the locking mechanism is adapted to prevent engagement of the cartridge within the frame prior to the removably mountable frame being engagedly received within the image processing apparatus.

10. A removably mountable frame according to claim 1, further comprising a locking mechanism to secure the cartridge in position relative to the frame.

11. A removably mountable frame according to claim 10, where the locking mechanism is adapted to engage the cartridge prior to the frame driving force transmitting means engaging the cartridge driving force receiving means.

12. A removably mountable frame according to claim 1, having at least one electrical contact to facilitate the transfer of electrical power from the image processing apparatus to the removably mountable frame.

13. A removably mountable frame according to claim 12, where the electrical contact is an electrode.

14. A removably mountable frame according to claim 1, having at least one micro-processor to facilitate the exchange of information between the frame and the image processing apparatus.

15. A removably mountable frame according to claim 1, further comprising actuation means for actuating interior elements of the image processing apparatus required to effect normal operation of the cartridge.

16. A cartridge for use in a removably mountable frame according to claim 1, the cartridge comprising: at least one xerographic component; and at least one cartridge driving force receiving member, one of the at least one cartridge driving force receiving members adapted to transfer driving force applied thereto to one of the at least one xerographic components, where the cartridge is adapted to be received in the removably mountable frame such that each of the at least one cartridge driving force receiving members co-axially engages a corresponding frame driving force transmitting means.

17. A cartridge according to claim 16, where the at least one xerographic component includes at least one of the following: a developer roller; a photosensitive drum; an agitator.

18. A cartridge according to claim 17, where the at least one xerographic component further includes at least one of the following: a toner hopper; a cleaning blade; a charging system; a supply roller; a triboelectric blade a scavenger unit.

19. A cartridge according to claim 18, where when the at least one xerographic component includes a toner hopper, the toner hopper is removable.

20. A cartridge according to claim 19, where the toner hopper is only able to be removed from the cartridge a predetermined number of times.

21. A cartridge according to claim 18, where when the at least one xerographic component includes a toner hopper, the toner hopper has an outlet provided therein to facilitate replenishment of toner stored therein.

22. A cartridge according to claim 17, where, when the at least one xerographic component includes a photosensitive drum, the cartridge further comprises a longitudinal aperture positioned and of a width such that, when the mated cartridge and frame are received within an image processing apparatus, a light source mounted within the image processing apparatus can ascribe an image onto the photosensitive drum along its full process width through the longitudinal aperture.

23. A cartridge according to claim 22, where the cartridge further comprises a retractable cover adapted to cover the longitudinal aperture in a first position and to at least partially uncover the longitudinal aperture in a second position, the retractable cover based towards the first position and operable to overcome the bias and move to the second position when the cartridge is received within the removably mountable frame.

24. A cartridge according to claim 17, wherein, when the at least one xerographic component includes a photosensitive drum, the cartridge further comprises a longitudinal aperture positioned and of a width such that, when the mated cartridge and frame are received within an image processing apparatus, an image ascribed onto the full process width of the photosensitive drum can be transferred to a transfer medium by way of the longitudinal aperture.

25. A cartridge according to claim 24, where the cartridge further comprises a retractable cover adapted to cover the longitudinal aperture in a first position and to at least partially uncover the longitudinal aperture in a second position, the retractable cover based towards the first position and operable to overcome the bias and move to the second position when the cartridge is received within the removably mountable frame.

26. A cartridge according to claim 16, having at least one electrical contact to facilitate the transfer of electrical power from either the reusable frame or an image processing apparatus in which the reusable frame is received.

27. A cartridge according to claim 26, where the electrical contact is an electrode.

28. A cartridge according to claim 16, having at least one micro-processor to facilitate the exchange of information between the cartridge and the reusable frame or the cartridge and an image processing apparatus in which the reusable frame is received.

29. A removably mountable frame comprising:

a driving force receiving means adapted to engage a driving force transmitting means of an image processing apparatus when the removably mountable frame is received within the image processing apparatus; and at least two frame driving force transmitting means, each frame driving force transmitting means having a gear located at the same end thereof adapted to engage at least one cartridge driving force receiving means of a cartridge when the cartridge is engagedly received within the removably mountable frame, wherein the external configuration of the removably mountable frame when the cartridge is received therein is adapted to be received within the image processing apparatus, and wherein the driving force receiving means adapted to engage a driving force transmitting means of an image processing apparatus is further adapted to transfer driving force applied thereto to each of the at least two frame driving force transmitting means.

30. A removably mountable frame according to claim 29, where, when a cartridge release means is set to a first position, the at least two frame driving force transmitting means disengage the cartridge driving force receiving means and at least partially retracts into a housing and where, when the cartridge release means is set to a second position, the at least two frame driving force transmitting means at least partially projects from the housing to engage the corresponding cartridge driving force receiving means.

31. A removably mountable frame according to claim 30, where the cartridge release means is one of the following: a lever; a switch; or push-button.

32. A removably mountable frame according to claim 29, where the driving force receiving means adapted to engage a driving force transmitting means of an image processing apparatus is directly connected with one of the at least one frame driving force transmitting means.

33. A removably mountable frame according to claim 29, further including struts and/or braces to provide support for the cartridge when received therein.

34. A removably mountable frame according to claim 29, further including recesses or cut-away portions within the frame to facilitate correct receipt of the cartridge within the removably mountable frame.

35. A removably mountable frame according to claim 29, where ridges or protrusions extend from the frame to facilitate correct receipt of the cartridge.

36. A removably mountable frame according to claim 29, further comprising a locking mechanism to securely connect the removably mountable frame to the image processing apparatus and maintain the frame's position within the image processing apparatus.

37. A removably mountable frame according to claim 36, where the locking mechanism is adapted to prevent engagement of the cartridge within the frame prior to the removably mountable frame being engagedly received within the image processing apparatus.

38. A removably mountable frame according to claim 29, further comprising a locking mechanism to secure the cartridge in position relative to the frame.

39. A removably mountable frame according to claim 38, where the locking mechanism is adapted to engage the cartridge prior to the frame driving force transmitting means engaging the cartridge driving force receiving means.

40. A removably mountable frame according to claim 29, having at least one electrical contact to facilitate the transfer of electrical power from the image processing apparatus to the removably mountable frame.

41. A removably mountable frame according to claim 40, where the electrical contact is an electrode.

42. A removably mountable frame according to claim 29, having at least one micro-processor to facilitate the exchange of information between the frame and the image processing apparatus.

43. A removably mountable frame according to claim 29, further comprising actuation means for actuating interior elements of the image processing apparatus required to effect normal operation of the cartridge.

44. A cartridge for use in a removably mountable frame according to claim 29, the cartridge comprising:

at least one xerographic component; and at least two cartridge driving force receiving member, each of the at least two cartridge driving force receiving members adapted to transfer driving force applied thereto to one of the at least one xerographic components, where the cartridge is adapted to be received in the removably mountable frame such that each of the at least two cartridge driving force receiving members engages at least one frame driving force transmitting means.

45. A cartridge according to claim 44, where the at least one xerographic component includes at least one of the following: a developer roller; a photosensitive drum; an agitator.

46. A cartridge according to claim 45, where the at least one xerographic component further includes at least one of the following: a toner hopper; a cleaning blade; a charging system; a supply roller; a triboelectric blade a scavenger unit.

47. A cartridge according to claim 46, where when the at least one xerographic component includes a toner hopper, the toner hopper is removable.

48. A cartridge according to claim 47, where the toner hopper is only able to be removed from the cartridge a predetermined number of times.

49. A cartridge according to claim 46, where when the at least one xerographic component includes a toner hopper, the toner hopper has an outlet provided therein to facilitate replenishment of toner stored therein.

50. A cartridge according to claim 45, where, when the at least one xerographic component includes a photosensitive drum, the cartridge further comprises a longitudinal aperture positioned and of a width such that, when the mated cartridge and frame are received within an image processing apparatus, a light source mounted within the image processing apparatus can ascribe an image onto the photosensitive drum along its full process width through the longitudinal aperture.

51. A cartridge according to claim 50, where the cartridge further comprises a retractable cover adapted to cover the longitudinal aperture in a first position and to at least partially uncover the longitudinal aperture in a second position, the retractable cover based towards the first position and operable to overcome the bias and move to the second position when the cartridge is received within the removably mountable frame.

52. A cartridge according to claim 45, where, when the at least one xerographic component includes a photosensitive drum, the cartridge further comprises a longitudinal aperture positioned and of a width such that, when the mated cartridge and frame are received within an image processing apparatus, an image ascribed onto the full process width of the photosensitive drum can be transferred to a transfer medium by way of the longitudinal aperture.

53. A cartridge according to claim 52, where the cartridge further comprises a retractable cover adapted to cover the longitudinal aperture in a first position and to at least partially uncover the longitudinal aperture in a second position, the retractable cover based towards the first position and operable to overcome the bias and move to the second position when the cartridge is received within the removably mountable frame.

54. A cartridge according to claim 44, having at least one electrical contact to facilitate the transfer of electrical power from either the reusable frame or an image processing apparatus in which the reusable frame is received.

55. A cartridge according to claim 54, where the electrical contact is an electrode.

56. A cartridge according to claim 44, having at least one micro-processor to facilitate the exchange of information between the cartridge and the reusable frame or the cartridge and an image processing apparatus in which the reusable frame is received.

57. A removably mountable adaptor comprising:

a driving force receiving means adapted to engage a driving force transmitting means of an image processing apparatus when the removably mountable adaptor is received within the image processing apparatus; and at least one adaptor driving force transmitting means, each adaptor driving force transmitting means adapted to co-axially engage corresponding cartridge driving force receiving means of a cartridge when the cartridge is engagedly connected to the removably mountable adaptor, where the external configuration of the removably mountable adaptor when the cartridge is connected thereto is adapted to be received within the image processing apparatus and where the driving force receiving means adapted to engage a driving force transmitting means of an image processing apparatus is further adapted to transfer driving force applied thereto to each of the at least one adaptor driving force transmitting means.

58. A removably mountable adaptor according to claim 57, where, when a cartridge release means is set to a first position, the at least one adaptor driving force transmitting means disengages the cartridge driving force receiving means and at least partially retracts into a housing and where, when the cartridge release means is set to a second position, the at least one adaptor driving force transmitting means at least partially projects from the housing to co-axially engage the corresponding cartridge driving force receiving means.

59. A removably mountable adaptor according to claim 58, where the cartridge release means is one of the following: a lever; a switch; or push-button.

60. A removably mountable adaptor according to claim 57, where the driving force receiving means adapted to engage a driving force transmitting means of an image processing apparatus is directly connected with one of the at least one adaptor driving force transmitting means.

61. A removably mountable adaptor according to claim 57, further including recesses or cut-away portions within the adaptor to facilitate correct connection of the cartridge to the removably mountable adaptor.

62. A removably mountable adaptor according to claim 57, where ridges or protrusions extend from the adaptor to facilitate correct receipt of the cartridge.

63. A removably mountable adaptor according to claim 57, further comprising a locking mechanism to securely connect the removably mountable adaptor to the image processing apparatus and maintain the adaptor's position within the image processing apparatus.

64. A removably mountable adaptor according to claim 63, where the locking mechanism is adapted to prevent connection of the cartridge to the adaptor prior to the removably mountable adaptor being engagedly received within the image processing apparatus.

65. A removably mountable adaptor according to claim 57, further comprising a locking mechanism to secure the connection of the cartridge to the adaptor.

66. A removably mountable adaptor according to claim 65, where the locking mechanism is adapted to engage the cartridge prior to the adaptor driving force transmitting means engaging the cartridge driving force receiving means.

67. A removably mountable adaptor according to claim 57, having at least one electrical contact to facilitate the transfer of electrical power from the image processing apparatus to the removably mountable adaptor.

68. A removably mountable adaptor according to claim 67, where the electrical contact is an electrode.

69. A removably mountable adaptor according to claim 57, having at least one micro-processor to facilitate the exchange of information between the adaptor and the image processing apparatus.

70. A removably mountable adaptor according to claim 57, further comprising actuation means for actuating interior elements of the image processing apparatus required to effect normal operation of the cartridge.

71. A cartridge for use in a removably mountable adaptor according to claim 57, the cartridge comprising:

at least one xerographic component; and at least one cartridge driving force receiving member, one of the at least one cartridge driving force receiving members adapted to transfer driving force applied thereto to one of the at least one xerographic components, where the cartridge is adapted to be connected to the removably mountable adaptor such that each of the at least one cartridge driving force receiving members coaxially engages a corresponding adaptor driving force transmitting means.

72. A cartridge according to claim 71, where the at least one xerographic component includes at least one of the following: a developer roller; a photosensitive drum; an agitator.

73. A cartridge according to claim 72, where the at least one xerographic component further includes at least one of the following: a toner hopper; a cleaning blade; a charging system; a supply roller; a triboelectric blade a scavenger unit.

74. A cartridge according to claim 73, where when the at least one xerographic component includes a toner hopper, the toner hopper is removable.

75. A cartridge according to claim 74, where the toner hopper is only able to be removed from the cartridge a predetermined number of times.

76. A cartridge according to claim 73, where when the at least one xerographic component includes a toner hopper, the toner hopper has an outlet provided therein to facilitate replenishment of toner stored therein.

77. A cartridge according to claim 72, where, when the at least one xerographic component includes a photosensitive drum, the cartridge further comprises a first longitudinal aperture positioned and of a width such that, when the mated cartridge and frame are received within an image processing apparatus, a light source mounted within the image processing apparatus can ascribe an image onto the photosensitive drum along its full process width through the longitudinal aperture.

78. A cartridge according to claim 77, where the cartridge further comprises a retractable cover adapted to cover the longitudinal aperture in a first position and to at least partially uncover the longitudinal aperture in a second position, the retractable cover based towards the first position and operable to overcome the bias and move to the second position when the cartridge is received within the removably mountable frame.

79. A cartridge according to claim 72, where, when the at least one xerographic component includes a photosensitive drum, the cartridge further comprises a longitudinal aperture positioned and of a width such that, when the mated cartridge and frame are received within an image processing apparatus, an image ascribed onto the full process width of the photosensitive drum can be transferred to a transfer medium by way of the longitudinal aperture.

80. A cartridge according to claim 79, where the cartridge further comprises a retractable cover adapted to cover the longitudinal aperture in a first position and to at least partially uncover the longitudinal aperture in a second position, the retractable cover based towards the first position and operable to overcome the bias and move to the second position when the cartridge is received within the removably mountable frame.

81. A cartridge according to claim 71, having at least one electrical contact to facilitate the transfer of electrical power from either the reusable frame or an image processing apparatus in which the reusable frame is received.

82. A cartridge according to claim 81, where the electrical contact is an electrode.

83. A cartridge according to claim 71, having at least one micro-processor to facilitate the exchange of information between the cartridge and the removably mountable adaptor or the cartridge and an image processing apparatus in which the removably mountable adaptor is received.

84. A removably mountable adaptor comprising:

a driving force receiving means adapted to engage a driving force transmitting means of an image processing apparatus when the removably mountable adaptor is received within the image processing apparatus; and at least two adaptor driving force transmitting means, each adaptor driving force transmitting means having a gear located at the same end thereof adapted to engage at least one cartridge driving force receiving means of a cartridge when the cartridge is engagedly connected to the removably mountable adaptor, wherein the external configuration of the removably mountable adaptor when the cartridge is connected thereto is adapted to be received within the image processing apparatus and wherein the driving force receiving means adapted to engage a driving force transmitting means of an image processing apparatus is further adapted to transfer driving force applied thereto to each of the at least two adaptor driving force transmitting means.

85. A removably mountable adaptor according to claim 84, where, when a cartridge release means is set to a first position, the at least two adaptor driving force transmitting means disengage the cartridge driving force receiving means and at least partially retracts into a housing and where, when the cartridge release means is set to a second position, the at least two adaptor driving force transmitting means at least partially projects from the housing to engage the corresponding cartridge driving force receiving means.

86. A removably mountable adaptor according to claim 85, where the cartridge release means is one of the following: a lever; a switch; or push-button.

87. A removably mountable adaptor according to claim 84, where the driving force receiving means adapted to engage a driving force transmitting means of an image processing apparatus is directly connected with one of the at least one adaptor driving force transmitting means.

88. A removably mountable adaptor according to claim 84, further including recesses or cut-away portions within the adaptor to facilitate correct receipt of the cartridge within the removably mountable adaptor.

89. A removably mountable adaptor according to claim 84, where ridges or protrusions extend from the adaptor to facilitate correct receipt of the cartridge.

90. A removably mountable adaptor according to claim 84, further comprising a locking mechanism to securely connect the removably mountable adaptor to the image processing apparatus and maintain the adaptor's position within the image processing apparatus.

91. A removably mountable adaptor according to claim 90, where the locking mechanism is adapted to prevent connection of the cartridge to the adaptor prior to the removably mountable adaptor being engagedly received within the image processing apparatus.

92. A removably mountable adaptor according to claim 84, further comprising a locking mechanism to secure the connection of the cartridge to the adaptor.

93. A removably mountable adaptor according to claim 92, where the locking mechanism is adapted to connect the cartridge prior to the adaptor driving force transmitting means engaging the cartridge driving force receiving means.

94. A removably mountable adaptor according to claim 84, having at least one electrical contact to facilitate the transfer of electrical power from the image processing apparatus to the removably mountable adaptor.

95. A removably mountable adaptor according to claim 94, where the electrical contact is an electrode.

96. A removably mountable adaptor according to claim 84, having at least one micro-processor to facilitate the exchange of information between the adaptor and the image processing apparatus.

97. A removably mountable adaptor according to claim 84, further comprising actuation means for actuating interior elements of the image processing apparatus required to effect normal operation of the cartridge.

98. A cartridge for use in a removably mountable adaptor according to claim 84, the cartridge comprising:

at least one xerographic component; and at least two cartridge driving force receiving member, each of the at least two cartridge driving force receiving members adapted to transfer driving force applied thereto to one of the at least one xerographic components, where the cartridge is adapted to be connected to the removably mountable adaptor such that each of the at least two cartridge driving force receiving members engages at least one adaptor driving force transmitting means.

99. A cartridge according to claim 98, where the at least one xerographic component includes at least one of the following: a developer roller; a photosensitive drum; an agitator.

100. A cartridge according to claim 99, where the at least one xerographic component further includes at least one of the following: a toner hopper; a cleaning blade; a charging system; a supply roller; a triboelectric blade a scavenger unit.

101. A cartridge according to claim 100, where when the at least one xerographic component includes a toner hopper, the toner hopper is removable.

102. A cartridge according to claim 101, where the toner hopper is only able to be removed from the cartridge a predetermined number of times.

103. A cartridge according to claim 100, where when the at least one xerographic component includes a toner hopper, the toner hopper has an outlet provided therein to facilitate replenishment of toner stored therein.

104. A cartridge according to claim 99, where, when the at least one xerographic component includes a photosensitive drum, the cartridge further comprises a longitudinal aperture positioned and of a width such that, when the mated cartridge and frame are received within an image processing apparatus, a light source mounted within the image processing apparatus can ascribe an image onto the photosensitive drum along its full process width through the longitudinal aperture.

105. A cartridge according to claim 104, where the cartridge further comprises a retractable cover adapted to cover the longitudinal aperture in a first position and to at least partially uncover the longitudinal aperture in a second position, the retractable cover based towards the first position and operable to overcome the bias and move to the second position when the cartridge is received within the removably mountable frame.

106. A cartridge according to claim 99, where, when the at least one xerographic component includes a photosensitive drum, the cartridge further comprises a longitudinal aperture positioned and of a width such that, when the mated cartridge and frame are received within an image processing apparatus, an image ascribed onto the full process width of the photosensitive drum can be transferred to a transfer medium by way of the longitudinal aperture.

107. A cartridge according to claim 106, where the cartridge further comprises a retractable cover adapted to cover the longitudinal aperture in a first position and to at least partially uncover the longitudinal aperture in a second position, the retractable cover based towards the first position and operable to overcome the bias and move to the second position when the cartridge is received within the removably mountable frame.

108. A cartridge according to claim 98, having at least one electrical contact to facilitate the transfer of electrical power from either the removably mountable adaptor or an image processing apparatus in which the removably mountable adaptor is received.

109. A cartridge according to claim 108, where the electrical contact is an electrode.

110. A cartridge according to claim 98, having at least one micro-processor to facilitate the exchange of information between the cartridge and the removably mountable adaptor or the cartridge and an image processing apparatus in which the removably mountable adaptor is received.

* * * * *